US008950130B2

(12) United States Patent
Chadwick

(10) Patent No.: US 8,950,130 B2
(45) Date of Patent: Feb. 10, 2015

(54) TECHNIQUES FOR BUILDING CONSTRUCTION USING FABRICATED TIMBERS

(71) Applicant: John Daines Chadwick, North Logan, UT (US)

(72) Inventor: John Daines Chadwick, North Logan, UT (US)

( * ) Notice: Subject to any disclaimer, the term of this patent is extended or adjusted under 35 U.S.C. 154(b) by 0 days.

(21) Appl. No.: 14/100,919

(22) Filed: Dec. 9, 2013

(65) Prior Publication Data

US 2014/0130449 A1 May 15, 2014

Related U.S. Application Data

(63) Continuation-in-part of application No. 13/250,828, filed on Sep. 30, 2011, now Pat. No. 8,601,761.

(51) Int. Cl.

| | |
|---|---|
| ***E04B 1/10*** | (2006.01) |
| ***E04C 3/30*** | (2006.01) |
| ***E04B 2/70*** | (2006.01) |
| *E04B 1/35* | (2006.01) |

(52) U.S. Cl.
CPC . *E04C 3/30* (2013.01); *E04B 2/702* (2013.01); *E04B 2001/3583* (2013.01)
USPC ..... 52/233; 52/223.8; 52/836

(58) Field of Classification Search
CPC ..... E04B 2/702; E04C 3/29
USPC ..... 52/223.8, 223.9, 223.11, 223.13, 231, 52/233, 291, 573.1, 741.13, 836, 843, 846
See application file for complete search history.

(56) References Cited

U.S. PATENT DOCUMENTS

| | | | |
|---|---|---|---|
| 4,034,527 | A | 7/1977 | Jalasjaa |
| 4,147,000 | A | 4/1979 | Lewandowski |
| 4,250,677 | A | 2/1981 | Yablonski |
| 4,305,238 | A | 12/1981 | Harward |
| 4,433,519 | A | 2/1984 | Jenkins |
| 4,439,957 | A | 4/1984 | Raasakka |
| 4,777,773 | A | 10/1988 | Fry |
| 5,103,610 | A | 4/1992 | Walters |
| 5,181,358 | A | 1/1993 | Mead |
| 5,253,458 | A | 10/1993 | Christian |
| 5,542,787 | A | 8/1996 | Charlanow |

(Continued)

OTHER PUBLICATIONS

Log Cabin—Wood Plastic Material products, buy Log Cabin, http://www.alibaba.com/product-gs/338982281/Log Cabin Wood Plastic Material.html, retrived Mar. 2, 2011.

(Continued)

*Primary Examiner* — Jeanette E Chapman
*Assistant Examiner* — James Buckle, Jr.
(74) *Attorney, Agent, or Firm* — L. Alan Collins; Collins & Collins Intellectual, LLC

(57) ABSTRACT

Techniques for building construction using fabricated timbers. In one example, such timbers are fabricated using conventional 2× (two-by) lumber to produce a square log appearance. These fabricated timbers are stacked to form outside and/or inside walls. The fabricated timbers and walls are configured to sustain desired vertical and lateral loads anticipated of a building such as a cabin, home, garage, barn, office building, or the like. A building constructed using such timbers appears to be built of square logs. Fabricated timber construction, as compared to conventional log or stick-frame construction, provides the appearance of high-quality log construction at a far lower cost, with higher R-values and appraised values, and is also far lower in cost and much simpler than conventional stick-frame construction.

20 Claims, 12 Drawing Sheets

(56) References Cited

U.S. PATENT DOCUMENTS

| | | | | |
|---|---|---|---|---|
| 5,765,970 | A | 6/1998 | Fox | |
| 7,549,263 | B1 | 6/2009 | Porter | |
| 7,785,712 | B2 | 8/2010 | Miller | |
| 2002/0046519 | A1 * | 4/2002 | Houseal | 52/233 |
| 2005/0055982 | A1 | 3/2005 | Medina | |
| 2007/0130866 | A1 | 6/2007 | Lott | |
| 2008/0174149 | A1 | 7/2008 | Simms | |
| 2009/0100780 | A1 | 4/2009 | Mathis | |
| 2010/0058700 | A1 | 3/2010 | LeBlang | |

OTHER PUBLICATIONS

Keops Interlock: Log Wall, http://www.logcabins.co.uk/images/wall lg.jpg, retrived Mar. 2, 2011.

Keops Interlock: Log Cabins, http://www,logcabins.co.uk/designguide.asp,retrived Mar. 2, 2011.

Prof. William M. Miller and Vince Chaijaroen, "Test Report on Shear Wall Test on Sing Walls for Singhome Company", McCleary, Washington, Oct. 4, 2002.

"Typical Wall Section", Sing Square Log Homes, Inc., 2003.

"Energy Savers: Structural Insulated Panels", http://www.energysavers.gov/your_home/insulation_airsealing/index.cfm/mytopic=11740, retieved Mar. 2, 2011.

FauxWoodBeams.com, "Faux Wood Ceiling Beams: The Look of Wood for Less", http://www.fauxwoodbeams.com/fauxbeams.php, retrieved Mar. 2, 2011.

Nygren, How to Build a Box Beam: eHow.com, http://www.ehow.com/how_4687132_build-box-beams.html, retrieved Mar. 2, 2011.

Forest & Wood Products Australia, "Plywood Box Beams Span Tables for Detached Housing Construction", Market Knowledge & Development Project No. PN08.1065, Jul. 2008.

"Planet-Era: The structural system of the Wentworth Project", Societe Planet-Era Action Inc. Institute, http://www.planet-era.ca/house/structureeng.htm, retrieved Mar. 2, 2011.

Barnstone, "Navy Demonstration Project", Article first published online Sep. 27, 2006.

Arnold, "Timber Construction", Building Systems Development in Building (1995).

Chase, Robert P. Jr., "Large 3-D Deflection and Force Analysis of Lateral Torsional Buckled Beams", Brigham Young University, Dec. 2006.

Carmody, "Builder's Foundation Handbook", May 1991.

* cited by examiner top view end view

TECHNIQUES FOR BUILDING CONSTRUCTION USING FABRICATED TIMBERS

RELATED APPLICATION(S)

This application is a Continuation in Part of and claims priority from U.S. patent application Ser. No. 13/250,828 that was filed on Sep. 30, 2011, and that is incorporated herein by reference in its entirety.

BACKGROUND

The term "timber" as used herein refers to wood suitable for use in the construction of a building or the like. Several main types of wood construction are generally known. These types use various forms of timber from logs to sawn/shaped timbers to smaller branches and leaves. These types also utilize various types of wall coverings from plant-based coverings to timber materials to earthen materials, such as mud or stone. A first type of wood construction is thatch construction, which is generally a traditional construction type. Other types include post-and-beam frame construction, walls with bamboo/reed mesh and post (waffle and daub), wooden frames with or without infill, and stud-wall frames with plywood/gypsum board sheathing. Two other types are wood panel construction and log construction.

The origin of log building construction is uncertain. The first log structures are thought to have been built in Northern Europe about 3500 BC. Early techniques involved stacking tree trunks on top of each other and overlapping the corners resulting in some of the first log cabins. The strength of log structures was improved with interlocking corners made by notching the logs near the ends and overlapping the log in the notches. Such interlocking corners brought the logs closer together making it easier to seal the structure against the weather by stuffing the spaces between logs with moss or other materials.

Logs used in construction are often peeled of their bark. When using younger logs with a significant taper over length, such logs may be hewn to reduce the taper. Logs may also be hewn or otherwise cut to make them square or rectangular instead of round. Traditionally, round log building were often considered temporary until a more permanent structure could be built. But square log craftsmanship is considered the original permanent home design. Some advantages of square log over round include:

Square logs are from the heart of a tree where shrinkage is minimal (typically less than 1 inch) as opposed to round logs with shrinkage of up to 5 inches. Thus, dealing with log shrinkage is much easier when using square logs.

Square logs can be fitted to better avoid water problems and associated rot than round logs. This results in longer building life. For example, square log homes over 500 years old are said to be common in Europe.

Square logs can easily be drilled for wiring and plumbing runs between courses while round logs, due to their shape, require chases or other methods of hiding wires and plumbing.

Unlike square logs, round logs tend to catch dust due to their shape. Round logs also make interior decorating more difficult due to their shape. Square logs, on the other hand, tend to be much easier for people to live with and keep clean. The term "square log" as used herein generally refers to a log or beam or timber or the like, composed of natural wood or any other material or combination of materials suitable for building construction, of some length, sections of which are substantially and consistently rectangular in shape, where one example of rectangular is square. Note that conventional square logs are made from natural wood and are typically fabricated as a single piece out of tree trunks.

For these advantages and more, modern log buildings built with square logs tend to enjoy a higher appraised value than round log buildings. In fact, the larger the square logs, the higher the value—and the cost. One reason for this is that square logs are generally cut from the heart of a tree and larger trees for making larger square logs tend to be scarce and expensive.

In recent times, log buildings have become increasingly popular for vacation cabins and even for homes. Various building techniques are combined to make such homes appealing and attractive. As a result, there is an increasing interest in and demand for log buildings and the timbers required to construct them. At the same time, the availability of old-growth timber suitable for producing larger logs is increasingly scarce and expensive.

SUMMARY

The following presents a simplified summary of the disclosure in order to provide a basic understanding to the reader. This summary is not an extensive overview of the invention nor does it identify key/critical elements of the invention or delineate the scope of the invention. Its sole purpose is to present some general concepts in a simplified form as a prelude to the more detailed description that is presented below.

The detailed description discloses techniques for building construction using fabricated timbers. In one example, such timbers are fabricated using conventional 2× (two-by) lumber to produce a square log appearance. These fabricated timbers are then stacked to form outside and/or inside walls such as for a building. The fabricated timbers and walls are configured to sustain the vertical and lateral loads anticipated for a building such as a cabin, house, garage, barn, office building, or the like. A building constructed of such timbers appears to be built of square logs. Variations provide for chinking between courses of timbers, or for timbers stacked without chinking. The height of each log course can be as little as a few inches to well over a foot or more. With one variation, the height of a log course can appear to be several feet or more. The terms "stacked" and "stacked one atop another" and the like as used herein typically refer to multiple objects (e.g., fabricated timbers) where one such object is placed on the bottom, and another such object is placed on top of the bottom object, and so forth until a top object is placed on the top of the stack of objects, thus forming a vertical stack of the multiple objects.

The disclosed techniques can be used with any type of building foundation including crawl space, slab-on-grade, and full basement, and with any type of roof structure. Further, construction using pre-manufactured fabricated timbers requires far fewer steps over conventional log and stick frame structures, as illustrated in Table 1 below.

TABLE 1

| Construction Steps | Fabricated Timbers | Conventional Logs | Stick-Frame & Stucco |
|---|---|---|---|
| Stack | A | B | |
| Frame | | | X |
| Exterior sheathing | | | X |
| Fabricate utilities chases | | C | |
| Wire | X | X | X |
| Plumb | X | X | X |

TABLE 1-continued

| Construction Steps | Fabricated Timbers | Conventional Logs | Stick-Frame & Stucco |
|---|---|---|---|
| Insulate | | | X |
| Seal | | X | |
| Sheet rock | D | E | X |
| Tape | | | X |
| Mud | | | X |
| Sand | | | X |
| Texture | | | X |
| Interior molding | X | X | X |
| Interior prime | | | X |
| Interior paint | | | X |
| Vapor barrier | | | X |
| Chink | X | X | |
| Windows | X | F | X |
| Doors | X | F | X |
| Exterior molding | X | X | X |
| Netting | | | X |
| Stucco | | | X |
| Stain/paint interior/exterior moldings | X | X | X |

In Table 1, an 'X' indicates a required construction step. Table 1 indicates that construction based on fabricated timbers takes far fewer steps than conventional stick-frame construction (and is thus correspondingly less labor intensive), but is also simpler and less labor intensive that conventional log construction. The various letters other than 'X' indicate the following:

A: stacking can be performed by two or three people without the use of heavy equipment such as a crane.

B: stacking requires the use of heavy equipment such as a crane.

C: Fabrication of chases for wiring and plumbing and the like in conventional log construction is very labor intensive and costly. This expensive step is not required when using fabricated timbers.

D: Due to very limited shrinkage of walls made of fabricated timbers (made from kiln dried lumber, typically less than 1" for a 10' wall), such walls can be wall-boarded if desired several months after construction.

E: Due to significant shrinkage of conventional log walls (typically several inches for a 10' wall), wall-boarding is generally not possible.

F: Due to significant shrinkage of conventional log walls (typically several inches for a 10' wall), installation of doors and windows requires extra-large cut-outs to accommodate shrinking over time, and may require adjusting moldings over time to account for shifting due to shrinkage.

Further, the R-value achievable by fabricated timbers typically ranges from 2.5 to 4 per inch of wall thickness, depending on the insulating material used inside and the height of the fabricated timber. For example, a fabricated timber using a 2×12 wood horizontal member typically provides an R-value of about R-40. In general, the taller each timber is in a wall, the greater the R-value provided by the wall. Further, taller and wider timbers tend to be more desirable because they can be made to have the appearance of tall and wide conventional logs which are very desirable due to the scarcity and high cost.

In addition, insulating materials that can be used in fabricated timbers may range from straw to conventional fiberglass wool, shredded paper (cellulose), or any other material that can provide a desired R-value, thus providing relatively low-cost, high-R-value walls. On the other hand, a conventional square logs typically provide an R-value of less than 2 per inch of log thickness. And a conventional 2×6 stick-frame wall typically provides approximately R-value of about 20. Thus, given fabricated timber construction, buildings that are far more heat-efficient can be easily and inexpensively constructed that also use far fewer materials and construction steps than conventional stick-frame construction, and at significantly lower cost and higher thermal efficiency than conventional log construction, yet with the high appraised values of high-quality conventional log construction. The term "R-value" as used herein is a conventional term that typically refers to the capacity of a material to resist heat flow.

Many of the attendant features will be more readily appreciated as the same become better understood by reference to the following detailed description considered in connection with the accompanying drawings.

DESCRIPTION OF THE DRAWINGS

The present description will be better understood from the following detailed description considered in connection with the accompanying drawings, wherein.

Like reference numerals are used to designate like parts in the accompanying drawings.

DETAILED DESCRIPTION

The detailed description provided below in connection with the accompanying drawings is intended as a description of the present examples and is not intended to represent the only forms in which the present examples may be constructed or utilized. The description sets forth at least some of the functions of the examples and/or the sequence of steps for constructing and operating the examples. However, the same or equivalent functions and sequences may be accomplished by different examples.

Although the present examples are described and illustrated herein as being implemented for building construction, the techniques described are provided as examples and not limitations. As those skilled in the art will appreciate, the present examples are suitable for application in a variety of different types of construction or the like.

Figure 1B:
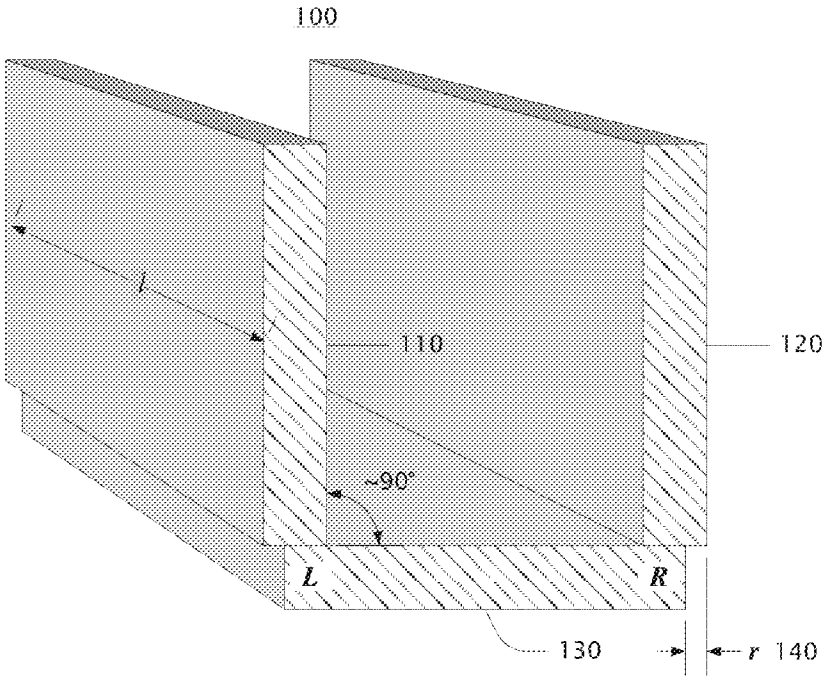
FIG. 1*b* is a diagram showing a 3-dimensional view of an example fabricated timber.
Figure 1A:
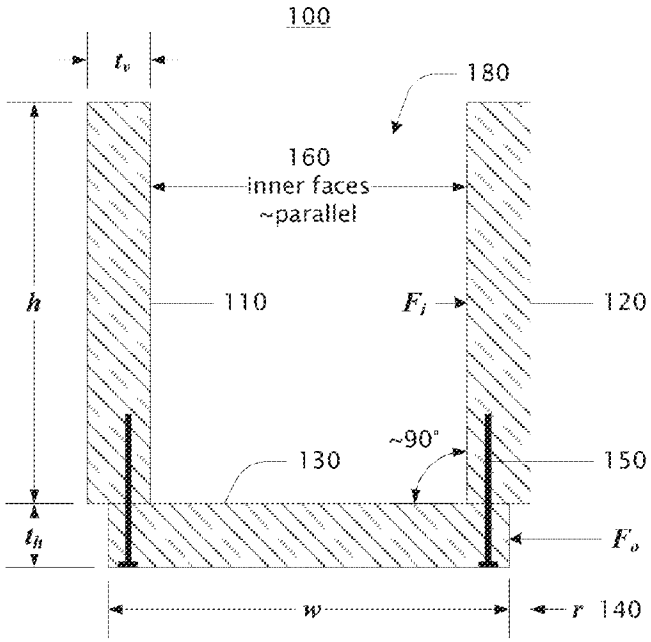
FIG. 1*a* is a diagram showing an end view of an example fabricated timber.

FIG. 1*a* is a diagram showing an end view of an example fabricated timber 100 with a 3-dimensional view of the same example fabricated timber 100 shown in FIG. 1*b*. Such a timber according to this example is typically fabricated with two vertical members (e.g., members 110 and 120) of thickness $t_v$ and height h disposed on a horizontal member (e.g., member 130) of thickness $t_h$ and width w, each of the three members having substantially the same length l. In one example, the length l of the various members is from one to thirty feet, the height of the vertical members is from three to fifty inches, the width of the horizontal member is from three to thirty inches, and the thickness of the various members is from one to four inches. In other examples, the lengths l of the members may vary from one another, as may the thicknesses $t_v$ of 110, $t_v$ of 120, and $t_h$ of 130. The surface measured by height h of the vertical members (e.g., 110 and 120) may represent a vertical plane of the members, and the surface measured by width w of the horizontal member (e.g., 130) may represent a horizontal plane of the member. The term "substantially" as used herein typically indicates "according to plan", "nominally", "conventionally", and "customary" in relation to the arts of house-scale building construction as known to those of average skill in the art. The term "from n to m <units>" as used herein (e.g., from one to thirty feet) typically refers to a specific measurement based on a particular unit of measure (e.g., feet or inches or the like) that is ≥n and ≤m. For example, eight feet is a distance in feet that is from one to thirty feet. Thirty-nine feet, on the other hand, is not from one to thirty feet.

One vertical member 110 is typically disposed length-wise atop the left side L of horizontal member 130, and the other vertical member 120 is typically disposed length-wise atop the right side R of horizontal member 130, as illustrated in FIG. 1*b*. Vertical members 110 and 120 typically have substantially the same height h. Each vertical member (e.g. 110 and 120) sits atop the horizontal member (e.g., 130) such that its height h is at an angle that is substantially perpendicular to or at a substantially 90 degree angle to the width w of the horizontal member (e.g., 130). The length l of supported vertical member 110 typically extends down the length l of horizontal member 130, and the length l of supported vertical member 120 also typically extends down the length l of horizontal member 130. Vertical members 110 and 120 are typically disposed length-wise atop horizontal member 130 so as to be substantially parallel with each other (e.g., 160), and to be substantially parallel with outer sides L and R of horizontal member 130. In one example, the shape of each member may generally be described as cuboid comprising three opposing pairs of rectangular faces. A conventional 2×4 stud, for example, is substantially cuboid in shape. A conventional sheet of plywood, for example, is also substantially cuboid in shape.

In some examples, vertical members 110 and 120 are fastened to horizontal member 130 using fasteners (e.g., 150) such as nails, screws, bolts, staples, pins, dowels, pegs, spikes, ties, strapping, adhesive, or the like. In one particular example, fastener 150 represents conventional 16d nails every n inches on center. The term "every n inches on center" as used herein refers to a fastener (e.g., a nail) installed so as to fasten the vertical member to the horizontal member as illustrated in FIG. 1*a*, with such a fastener installed at least every n inches along the length l of the vertical and horizontal members, each such fastener approximately centered between the inner vertical face $F_i$ of the vertical member (e.g., 110 and 120) and the outer vertical face $F_o$ of the horizontal member (e.g., 130). One example of n may be 8. In other examples, other types or sizes of fasteners may be installed at other increments along the length l of the vertical and horizontal members. In further examples, a fabricated timber may be cast, extruded, molded, hewn, carved, cut, milled, or otherwise fabricated as a single piece rather than fabricated of separate members 110, 120, and 130 as shown in the examples of FIGS. 1*a* and 1*b*.

Note that the horizontal and vertical members of a fabricated timber form a channel 180. This channel may be used for installing utilities such as electrical wires, gas and/or water lines, ducting, and the like. This channel may optionally be filled with insulation. Blocking may be added at the ends to keep insulation in, or ends may be covered with plastic, cardboard, or any other suitable material or the like to retail any insulation inside the fabricated timber. The term "blocking" as used herein typically refers to pieces of wood or other material (e.g., 224) disposed between members (e.g., 110 and 120) to provide support, attachment sites, or brace against lateral-torsion buckling, or the like.

The composition of fabricated timbers (e.g., 100) as described herein is not limited to wood, but may be plastic, fiber-cement, metal, laminated materials, composites, or the like, or any combination of such. In one example, conventional 2× lumber has been shown to be an inexpensive and readily available choice of materials that is simple to work with and that only requires commonly-available skills and tools. The term "2× lumber" or "two-by lumber" as used herein generally refers to softwood or conifer sized to nominal standardized dimensions as commonly used in construction of wood-buildings and the like, where the number '2' in "2×" typically refers to the nominal pre-dried 2-inch thickness of the lumber which typically measures about 1.5 inches once dried. Such 2× lumber used in the construction of fabricated timbers and the like is typically kiln dried or the like. Note that other types and sizes of lumber may also be used in fabricated timbers, including hardwood, rough-cut wood, or wood of thicknesses less than or greater than about 1.5 inches, etc. The only factor limiting the composition of a fabricated timber 100 is that it should possess certain attributes as described herein below.

In the example where members 110, 120, and 130 are each separate members, one attribute that these members should possess is a common shrinkage characteristic. The term "shrinkage characteristic" as used herein refers to expected amounts and directions of shrinkage over time and/or under particular conditions for a particular material (e.g., wood, etc.). Further, should the material from which members (e.g., 110, 120, and 130) are fabricated include a grain (as with e.g., wood, fiber-cement, etc.), the grain of each member should be oriented in substantially the same plane, such as a horizontal plane. Such grain alignment may result in shrinkage over time that is relatively consistent in direction and amount between each of the members. Further, any given member (e.g., 110, 120, and 130) may actually comprise multiple separate members of various lengths positioned end-to-end resulting in an overall length of l. The term "grain" as used herein typically refers to an overall direction of a pattern of fibers or the like of a material such as that from which members of a fabricated timber are comprised.

The term "fabricated timber" as used herein refers to a statutory article(s) of manufacture constructed according various example methods described herein and that is configured for possessing various attributes specified herein. The term "fabricated timber" does not refer to any pre-existing article(s) of manufacture or the like. Nor does it suggest any pre-existing method(s) of construction or the like.

In one example of a fabricated timber 100, a vertical member (e.g. 120) is disposed atop a horizontal member (e.g., 130) such that the outer portion of the vertical member overhangs the horizontal member resulting in a reveal, such as reveal r 140. Either or both vertical members may be disposed to provide such a reveal r 140. Such a reveal is typically from 0% up to about 50% of the thickness $t_v$ of the vertical member. Such a reveal can be used for, among other things, a location for chinking or the like and/or running wiring, plumbing, and/or other utilities or the like as described below. In one example, a reveal up to ¾ inch (about ¼ inch being preferred) is provided for chinking or the like. The term "reveal" as used herein typically refers to a side of an opening between an outer surface and an inner surface. An example of such a side of an opening is provided by r 140 with respect to the outer surface of member 120 (opposite $F_i$) and to the inner surface $F_o$ of member 130.

In another example of a fabricated timber 100, a vertical member (e.g. 120) is positioned atop a horizontal member (e.g., 130) such that no reveal is provided, but such that the outer face of the vertical member is substantially flush with the outer side of the horizontal member instead. Such a "no reveal" configuration may provide for stacked timbers that have an appearance of a square log with a height that is the combined height of the stacked timbers where the horizontal interfaces between the stacked logs are dressed so as to be substantially non-visible. Other "no reveal" configurations are also acceptable, as described below.

The term "dressed" ("dressing", "dress", and the like) as used herein typically indicates treating the outside faces of individual or stacked fabricated timbers and/or interfaces of stacked fabricated timbers to have a desired appearance. For example, it may be desirable for the outside faces of fabricated timbers to have the appearance of a square log, a peeled log, and/or a rough-hewn log, or the like. In one example, the outside faces and/or interfaces of such timbers may be distressed using a chainsaw or the like to produce an appearance and texture of a rough-hewn log. Interfaces may be filled with wood filler or the like to hide them before or after distressing. Such dressing or distressing may be performed prior to timbers being stacked, or after stacking, or both. The term "desired" as used herein typically refers to some quality or characteristic or the like that is expected as a result of some action, design, planning, or the like.

Other aspects of the term "dressed" as used herein may include staining, tinting, painting, or otherwise coloring, finishing, and/or otherwise treating the faces, visible portions, and/or interfaces of fabricated timbers. Other examples may include sealing and/or waterproofing or the like. Another example may include chinking, such as with conventional chinking, cement, sand mortar, grout, flexible vinyl chinking, or the like. Conventionally, chinking is used to seal gaps between logs. In the case of fabricated timbers, chinking is primarily used for aesthetic reasons and to obtain a conventional chinked appearance or the like.

Various attributes that a fabricated timber 100 configured for building construction should possess include the capability of sustaining various loads including at least dead loads, live loads, and environmental loads. The noun "building" as used herein typically refers to a structure (generally enclosed by walls and a roof) constructed to provide support and shelter for an intended occupancy. The term "occupancy" as used herein typically refers to the purpose for which a building or other structure, or portion thereof, is used or intended to be used. The term "load" as used herein typically refers to forces or other actions upon a building that result from the weight of building materials and the like, building occupants and/or their possessions, objects supported by the building, environmental effects, differential movement, restrained dimensional changes, and the like. The term "dead loads" as used herein typically refers to substantially permanent loads such as the weight of materials of construction incorporated into a building or structure including but not limited to walls, floors, roofs, ceilings, stairways, built-in partitions, finishes, and all other similarly incorporated construction materials, and all equipment and the like affixed to the building or structure, but not including live loads or environmental loads. In one example, a fabricated timber may be configured to sustain a desired dead load of at least fifteen pounds per square foot. The term "live loads" as used herein typically refers to loads produced by occupancy of a building or structure that do not include dead loads or environmental loads. In one example, a fabricated timber may be configured to support a desired live load of at least thirty pounds per square foot. The term "environmental loads" as used herein typically refers to loads that act on a building or structure as a result of weather, topography, or other natural phenomena including but not limited to wind, snow, rain, ice, seismic activity, temperature variations leading to thermal expansion or the like, ponding, dust, fluids, floods, and lateral pressures from soil, ground water, bulk materials against the building, and the like, but not including dead loads or live loads. In one example, a fabricated timber may be configured to support a desired environmental load of at least ten pounds per square foot. In another example, a fabricated timber may be configured to support at least the desired dead load, live load, and environmental load combined. The term "support" as used herein with respect to a fabricated timber typically indicates a capability to bear desired loads plus a safety factor without exceeding a yield strength of the fabricated timber or, in other words, while maintaining its elasticity.

Figure 2A:
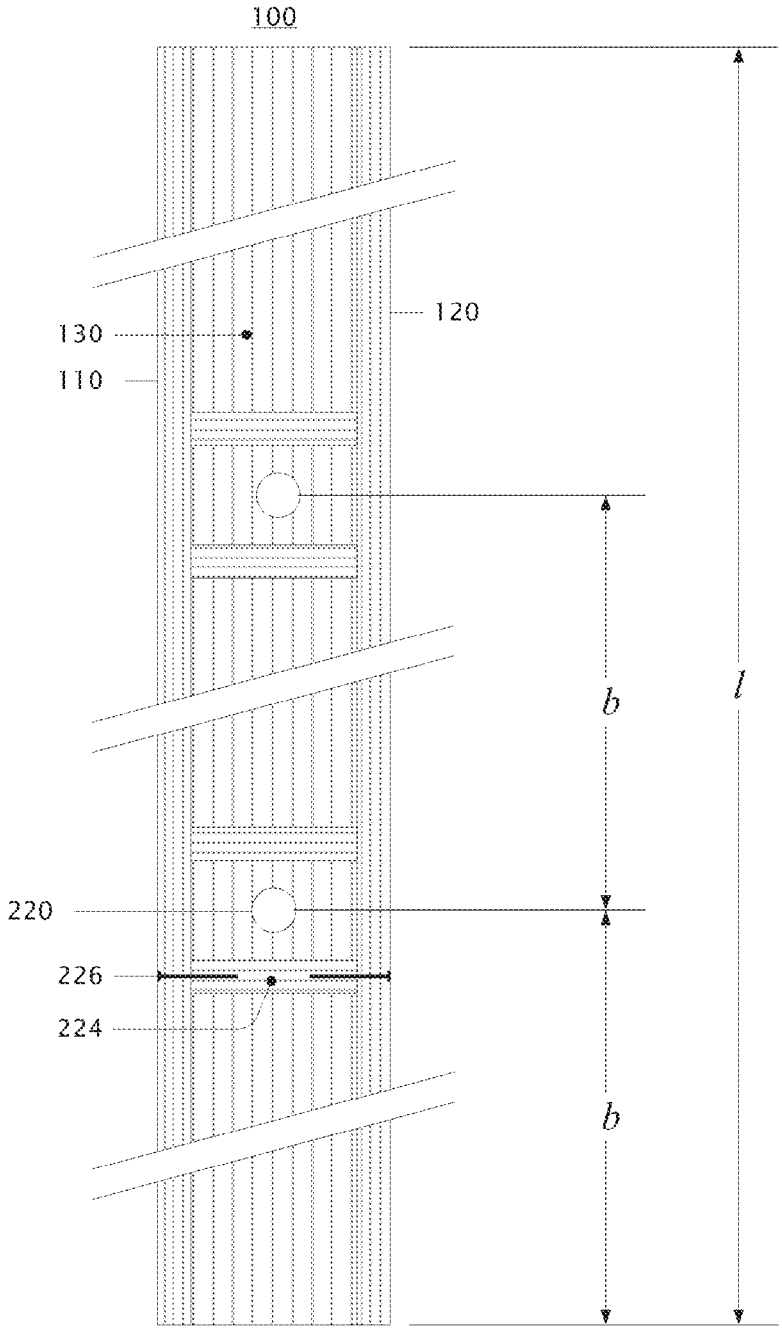
FIG. 2*a* is a diagram showing a top view of an example fabricated timber.

FIG. 2*a* is a diagram showing a top view of an example fabricated timber 100. This top view shows portions of example horizontal member 130 and example vertical members 110 and 120, as also shown in FIGS. 1*a* and 1*b*. Also shown in FIG. 2*a* are holes (e.g., 220) of sufficient diameter to allow tie-down fasteners to pass through horizontal member 130 via the holes, as well as blocking (e.g., 224) optionally disposed on one or both sides of each hole. In one example, holes (e.g., 220) in the horizontal member are located approximately every m feet on center. The term "every m feet on center" as used herein refers to a hole at least every m feet along the length l of the horizontal member, each such hole approximately centered within the width w of the horizontal member (e.g., 130). In another example, holes (e.g., 220) may be provided at other increments (e.g., every b units) along the length l of the horizontal member. In other examples, a fabricated timber 100 may be fabricated to include the holes (e.g., 220) and optional blocking (e.g., 224) as a single member. Note that any blocking (e.g., 224) may comprise holes and/or notches (e.g., 225) to facilitate utility runs such as wiring, plumbing, etc. Any one block may comprise from one to four corner notches (only one 225 shown in FIG. 2*b*) and/or any number of holes. Generally all blocking in a fabricated timber would comprise the same hole/notch number and pattern. The size of the holes/notches (e.g., 225) is typically sufficient for desired runs of wiring, plumbing, and other utilities and the like. Such blocking holes/notches (e.g., 225) may alternatively be referred to as "blocking utility ports".

Figure 2B:
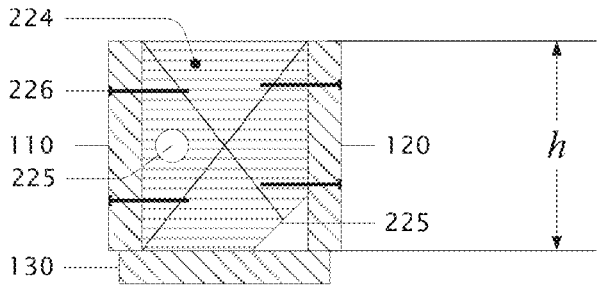
FIG. 2*b* is a diagram showing an end view of the example fabricated timber.

FIG. 2*b* is a diagram showing an end view of the example fabricated timber 100. This end view shows portions of example horizontal member 130 and example vertical members 110 and 120, as also shown in FIGS. 1*a* and 1*b*. Also shown in FIG. 2*b* is an end view of example blocking 224. The composition of the blocking (e.g., 224) is typically the same as that of the fabricated timber's members (e.g., 110, 120, and 130). Further, should the material from which members 110, 120, 130, and 224 are fabricated include a grain (as with e.g., wood, fiber-cement, etc.), the grain of each member, including blocking members (e.g., 224), should be oriented in substantially the same plane. Such grain alignment may result in shrinkage over time that is relatively consistent between each of the members. In one example, blocking (e.g., 224) is attached to vertical member (e.g., 110 and 120) with fasteners (e.g., 226) as illustrated in FIG. 2*b*. In a particular example, blocking is fastened by installing two nails on each side (e.g., 110 and 120), as illustrated. Alternatively or additionally, the fasteners (e.g., 226) may be installed on the bottom (e.g., 130) and/or through the bottom of a next timber (e.g., FIG. 3, 330), leaving the outer faces of the vertical members free from any appearance of fasteners. In another example, other types or sizes of fasteners may be installed to fasten blocking. Note that the height h of the blocking is substantially the same as the height h of vertical members 110 and 120. Preferably, the blocking height is not greater than, but may be the same as or somewhat less than the height of the vertical members.

Figure 3:
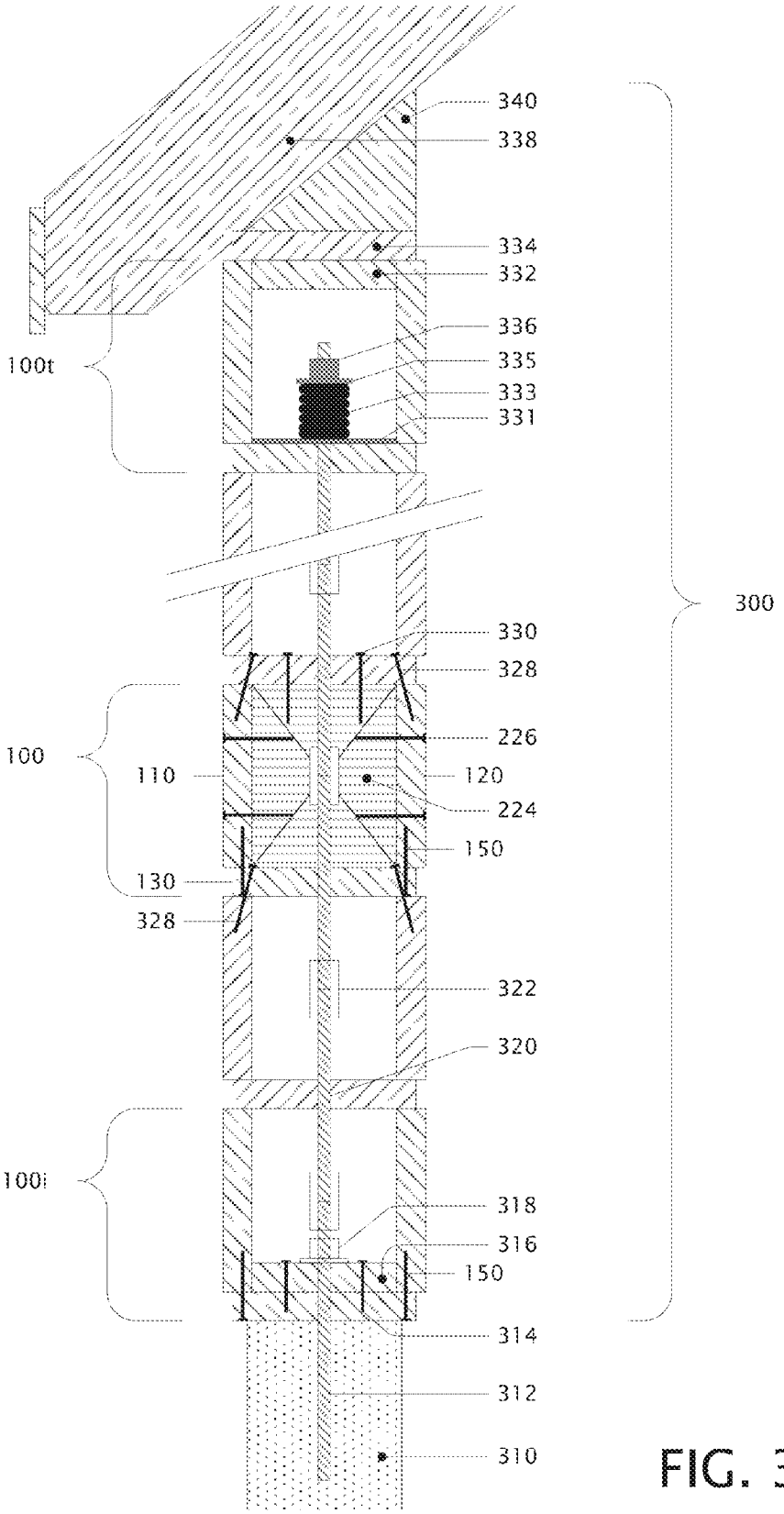
FIG. 3 is a diagram showing an example of an example wall constructed from a plurality of fabricated timbers.

FIG. 3 is a diagram showing an example wall 300 constructed from a plurality of example fabricated timbers (e.g., 100*i*, 100, and 100*t*). In this example, bottom fabricated timber 100*i* is attached atop foundation 310. Alternatively, the bottom fabricated timber 100*i* may be positioned atop any other type of foundation suitable for a building or structure. The term "foundation" as used herein typically refers to the lowest load-bearing portion of a building which may comprise any suitable design and material. In this example, tie-down fasteners (e.g., 312) may be embedded in or attached to the foundation using conventional techniques. The tie-down fasteners may be comprised of multiple components (e.g., 312, 320, and 322) and may continue upward via holes in the horizontal member (e.g., 130) of each fabricated timber (e.g., 100*i*, 100, and 100*t*, as well as all other fabricated timbers). The term "tie-down fastener" as used herein typically refers to a fastening device or mechanism configured to secure some object(s) (e.g., a fabricated timber(s)) against a base of some kind (e.g., a foundation).

In one example, bottom fabricated timber 100*i* may include an optional additional member (e.g., 316) that may be fastened to the top of its horizontal member inside the timber via fasteners (e.g., 314) and further attached to the foundation via a nut and washer or the like (e.g, 318), thus locking down the bottom fabricated timber 100*i* to the foundation.

Example wall 300 extends upward to the desired height by stacking and attaching fabricated timbers one atop another starting with a bottom fabricated timber (e.g., 100*i*) up through the top fabricated timber (e.g., 100*t*). The fabricated timbers are typically stacked so as to be level horizontally and to be substantially plumb. Such stacking can typically be performed by two or three people (workers) without the use of a crane or other heavy equipment or the like. The holes in the horizontal members may be sufficiently aligned vertically so as to allow tie-down fasteners (e.g., 312 & 320) to pass through each stacked fabricated timber while remaining substantially plumb vertically. In one example, the holes are drilled or otherwise formed by the workers as the timbers are stacked. One method of finding the correct location for each hole is to place the next timber in the desired horizontal position above the lower timber and atop the applicable and substantially plumb tie-down fasteners, beat the horizontal member of the next timber against the tops of the tie-down fasteners so as to form discernible marks on its bottom at the locations where the tie-down fasteners touch the horizontal member, and then drill or otherwise form the holes according to the marks. This method typically allows for the holes to be formed by the workers at the required locations along the horizontal member of the next timber at the job site without complex design or measurements or the like.

Regarding the tie-down fasteners, these fasteners may be attached to or embedded in foundation 310 at their lower ends, that extend through the courses of stacked fabricated timbers forming a wall, and that are fastened to the top of the wall thus maintaining the wall in a high degree of force over time against the foundation (e.g., 310). Such tie-down fasteners may be configured to maintain the high degree of force on the wall, even in the event of shrinkage of the wall's fabricated timbers and in the event that various forces are applied to the wall, including environmental forces such as wind, earthquake, shifting, flooding, and the like.

In one example, each tie-down fastener may be a threaded rod, or a plurality of threaded rods (e.g., 320) coupled together by coupler nuts (e.g., 322). A bottom rod, also known as an anchor bolt, (e.g., 312) may be embedded in or otherwise attached to the building's foundation (e.g., 310) via conventional means. The bottom rod may be sufficiently long to pass through the first course of fabricated timbers (e.g., 100*i*) and may be coupled via a coupling nut (e.g., 322) or the like to a second rod (e.g., 320) that is sufficiently long to pass through at least a second course of fabricated timbers, etc., until a final rod or top portion of a single rod passes into and/or through a top fabricated timber (e.g., 100*t*). In one example, a tie-down fastener and related components may terminate against the horizontal member of the top fabricated timber. In another example, wall cap members 332 and 334 may cap the final course of fabricated timbers and allow for the tie-down fastener(s) to hold the stacked courses of fabricated timbers against the building foundation (e.g., 310). Member 332 may be optional. Member 334 may be the same width as a horizontal member (e.g., 130) or extend up to the entire width of a fabricated timber (e.g., 100*t*). The desired holding force may be achieved via a tensioner mechanism (e.g., 333) such as a spring or the like positioned atop a washer or plate (e.g., 331) locked in position via the rod (e.g., 320) by a nut (e.g., 336) and washer (e.g., 335) or other suitable locking device(s). Any other suitable tensioner mechanism may alternatively/additionally be used to provide the desired force on the wall 300. In one example (not illustrated), the tensioner mechanism may be installed on top of wall top cap (e.g., 332 and 334). In another example, the tensioner mechanism may be installed inside the top fabricated timber 100*t* against its horizontal member as illustrated in FIG. 3. In one example of a wall constructed using fabricated timbers, the tie-down fasteners comprise threaded metal rods (e.g., 320) ⅝ inches in diameter joined by coupler nuts (e.g., 322) as needed, the bottom rods or anchor bolts (e.g., 312) embedded at least 6 inches in a conventional concrete foundation (e.g., 310), the tie-down fasteners spaced at least every 4 feet along the horizontal length of the wall (e.g., 300), with the top ends attached via tensioner mechanisms (e.g., 333) and associated components (e.g., 331, 335, and 336), and where each combination of tie-down fastener, tensioner mechanism, and associated components (e.g., 331, 335, and 336) has a tension capacity of at least 2,500 lbs. The term "tension capacity" as used herein is related to a material's or object(s)'s "tensile strength" and indicates a rated usage value below such a tensile strength. The term "associated components" as used herein typically refers to various pieces of hardware or the like required to complete, secure, and/or retain a tie-down fastener and/or tensioner mechanism, pieces of hardware such as washers, plates, nuts, pins, and the like.

Each course of fabricated timbers of a wall is typically attached to the previous course. FIG. 3 shows an example of how one course can be attached to the previous course. In this example, fasteners (e.g., 328 and 330) are installed to attach a next fabricated timber that is being stacked atop a previously stacked fabricated timber. Fasteners (e.g., 328) are installed so as to attach the horizontal member of the next fabricated timber to the vertical members (e.g., 110 and 120) of the previous fabricated timber (e.g., 110). Further, additional fasteners (e.g., 330) may be installed so as to attach the horizontal member of the next fabricated timber to some or all of the blocking (e.g., 224) of the previous fabricated timber (e.g., 110).

Prior to attaching a next fabricated timber to the previous fabricated timber, gaps and the like between the two may be substantially removed. In one example, this is done by compressing the next fabricated timber against the previous fabricated timber sufficient to remove such gaps. Such may be accomplished using existing tie-down fasteners to force the next fabricated timber toward the foundation until gaps and the like between the next fabricated timber and the previous fabricated timber are substantially eliminated. Given a threaded rod tie-down fastener, a plate or the like may be slid down the rod against the top of the next fabricated timber, and a nut tightened against the plate to remove any gaps. Then, while under compression with gaps substantially removed, the next fabricated timber may be attached to the previous fabricated timber.

As one fabricated timber is stacked atop another, one or more beads of caulking and/or glue or the like may be applied. In one example, a bead of caulking may be applied along the length of a top of a fabricated timber's vertical members (e.g., 110 and 120) prior to stacking another fabricated timber on top of it. Such a bead may be applied along the inside and/or outside edge(s) of the vertical members, or along any other portion of the vertical members. One such bead may be formed from a caulking or the like that is configured to remain flexible over time, though cycles of hot and cold seasons, and to seal out moisture, bugs, air, and/or other substances and/or objects, and be further configured to maintain such a seal given settling, movement, shrinkage, or the like of the fabricated timbers. Another such bead may be similarly applied that is formed of glue or construction adhesive or the like.

A wall constructed of fabricated timbers that supports angled trusses may also include weight distribution members that typically approximate the shape of a right triangle, as illustrated in FIG. 3 by element 340. In one example, one such weight distribution member (e.g., 340) is installed atop the wall (e.g., 300) under each truss (e.g., 338). Each such weight distribution member is typically disposed and configured to evenly distribute the various loads imposed by the truss across the top surface of the top course of fabricated timbers (e.g., 100*t*). The width of such a weight distribution member is typically about the same as the width of the wall top cap or the like that it is disposed upon. The height and hypotenuse of the weight distribution member are typically configured to support the truss by contact along the length of the hypotenuse. Such a weight distribution member may be fabricated any of the materials suitable for members of a fabricated timber.

Figure 4:
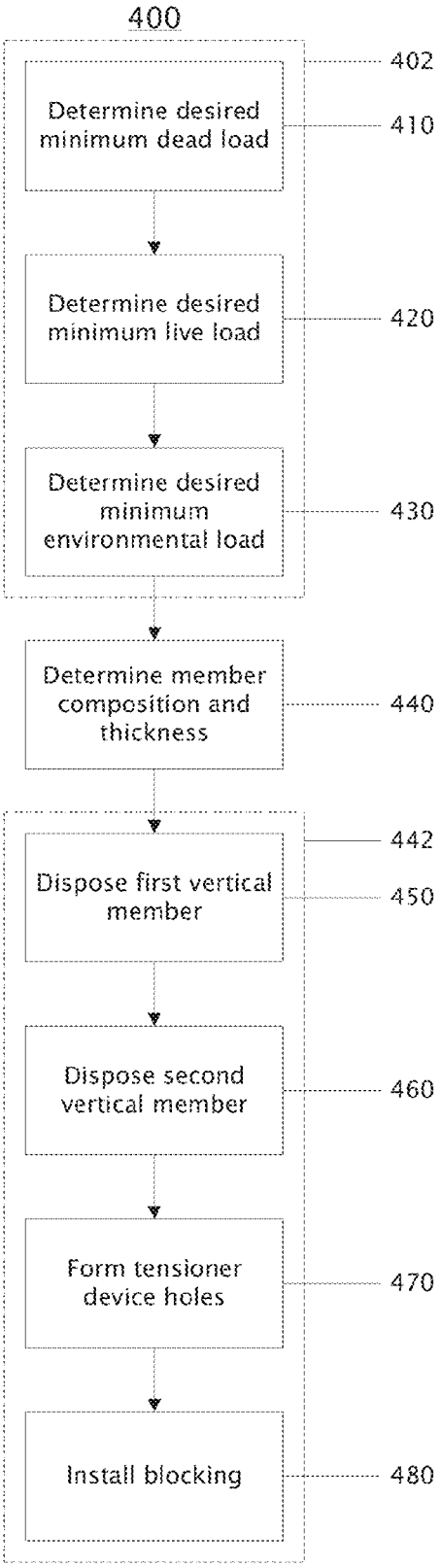
FIG. 4 is a diagram showing an example of a method for constructing a fabricated timber.

FIG. 4 is a diagram showing an example method 400 for constructing a fabricated timber. Such timbers may be partially or completely assembled as pre-manufactured timbers off-site at a factory or the like, or they may be partially or entirely assembled on-site. In both cases, the basic process of construction is typically the same.

Block 402 typically indicates determining a total desired load plus a safety factor that the fabricated timber should support without exceeding its yield strength. The total desired load may be a minimum, and is typically comprised of a determined desired minimum dead load (block 410) plus a determined desired minimum live load (block 420) plus a determined desired minimum environmental load (block 430). Each of these determined loads may be based at least on the overall design, occupancy, and physical environment of the building. Alternatively, desired average, maximum, or other loads may be used instead of desired minimum loads.

Block 440 typically indicates determining a composition of each of the various members of the fabricated timber. Such determining may be based at least on the determined desired loads (e.g., block 402) and aspects of the design, occupancy, and physical environment of the building comprising the fabricated timber. Such determining may also take into account a desired outside dressing and/or desired inside dressing of the fabricated timber. Note that the various members of a fabricated timber need not be of the same composition. Nor need one fabricated timber (or various members thereof) used in a building be of the same composition as another fabricated timber (or various members thereof) used in the building.

Block 440 also typically indicates determining a thickness of the various members of the fabricated timber, such as members 110, 120, 130, and 224. Such determining may be based at least on the determined desired loads (e.g., block 402) and aspects of the design, occupancy, and physical environment of the building comprising the fabricated timber. Such determining may also take into account a desired outside dressing and/or desired inside dressing of the fabricated timber. Note that the various members of a fabricated timber need not be of the same thickness. Nor need one fabricated timber (or various members thereof) used in a building be of the same thickness as another fabricated timber (or various members thereof) used in the building.

The end result of the determinings indicated by block 440 is generally that the compositions and thicknesses of the various members of the fabricated timber have been determined. Another aspect (not explicitly indicated in FIG. 4) is determining the length of the fabricated timber or each of the fabricated timbers used in a building or wall or the like. Generally the length of each fabricated timber is based upon it position in a wall of a building or the like, the position of windows, doors, and other opening, the length of the wall, etc. A typical fabricated timber may generally be between approximately one and thirty feet in length. Should a wall require greater lengths, two or more such fabricated timbers may be disposed end-to-end to obtain the desired overall length. Yet another aspect (not explicitly indicated in FIG. 4) is determining the width of the horizontal member and the height of the vertical members of the fabricated timber or of each of the fabricated timbers used in a building or wall or the like. The width may be determined based on a desired thickness of a wall or portion thereof. The desired thickness may be based on a desired amount of insulating value, a desired appearance, or other factors that may impact the width of a wall or portion thereof. The desired height may be determined based on a desired timber height, desired appearance, desired locations of windows and/or other openings, desired wall heights, roof heights, and floor heights (such as in multi-level structures), and the like.

Block 442 typically indicates various aspects of constructing a fabricated timber. Block 450 typically indicates disposing a first vertical member atop a horizontal member. In one example, the first vertical member 110 is typically disposed length-wise atop the left side L (or the right side R) of horizontal member 130, as illustrated in FIG. 1*b*. The first vertical member may be disposed to provide a reveal r 140, as illustrated in FIG. 1*b*. The first vertical member 110 may be fastened to the horizontal member 130 using fasteners installed every n inches on center or the like, and/or the horizontal member and the first vertical member may be fabricated as a single piece. The disposing of the first vertical member atop the horizontal member may take place at a job site as part of the construction of a wall of a building, or as part of a process of construction a plurality of fabricated timbers such as for later use in constructing walls or the like.

Block 460 typically indicates disposing a second vertical member atop a horizontal member. In one example, the second vertical member 110 is typically disposed length-wise atop the right side R (or the left side L, whichever side the first vertical member is not disposed on), of horizontal member 130, as illustrated in FIG. 1*b*. The second vertical member may be disposed to provide a reveal r 140, as illustrated in FIG. 1*b*. The second vertical member 110 may be fastened to the horizontal member 130 using fasteners installed every n inches on center or the like, and/or the horizontal member and the second vertical member may be fabricated as a single piece. The disposing of the second vertical member atop the horizontal member may take place at a job site as part of construction of a wall of a building or the like, or as part of a process of construction a plurality of fabricated timbers for later use at another site in constructing walls or the like.

Block 470 typically indicates forming one or more holes in a horizontal member of a fabricated timber. In one example, each hole is formed so as to enable a tie-down fastener to pass through the fabricated timber via the hole. As fabricated timbers are stacked to form a wall, holes formed in each timber are typically aligned with holes formed in any timbers above and below such that a tie-down fastener can to pass through each set of aligned holes in a substantially vertical orientation, as partially illustrated in FIG. 3. Such holes may be formed off-site during timber fabrication in advance of wall construction, or as part of wall construction at a job site (the location of building construction). Holes are typically formed to allow for tie-down fasteners to be installed at approximately two foot or greater intervals along the length of a wall constructed of fabricated timbers. In one example, holes are formed to allow for a tie-down fastener to be installed at approximately four foot intervals along the length of a wall.

Block 480 typically indicates installing a fabricated timber's blocking. One example of such blocking is illustrated in FIG. 2*a* wherein a block is optionally installed on one or both sides of a formed hole. In one example, a block is installed about two to six inches on one or both sides of a formed hole's center. Such optional blocking is typically installed in each timber such that, when stacked, the blocking of the stacked timbers is substantially aligned vertically. That is, the optional hole blocking of one timber tends to be vertically aligned with that of any timbers above and/or below it. In another example, blocking may additionally or alternatively be installed at intervals unrelated to the location of formed holes. Such blocking of stacked timbers may be installed so as to be substantially aligned vertically. As with forming holes, blocking may be installed off-site during timber fabrication in advance of wall construction, or as part of wall construction at a job site.

Figure 5:
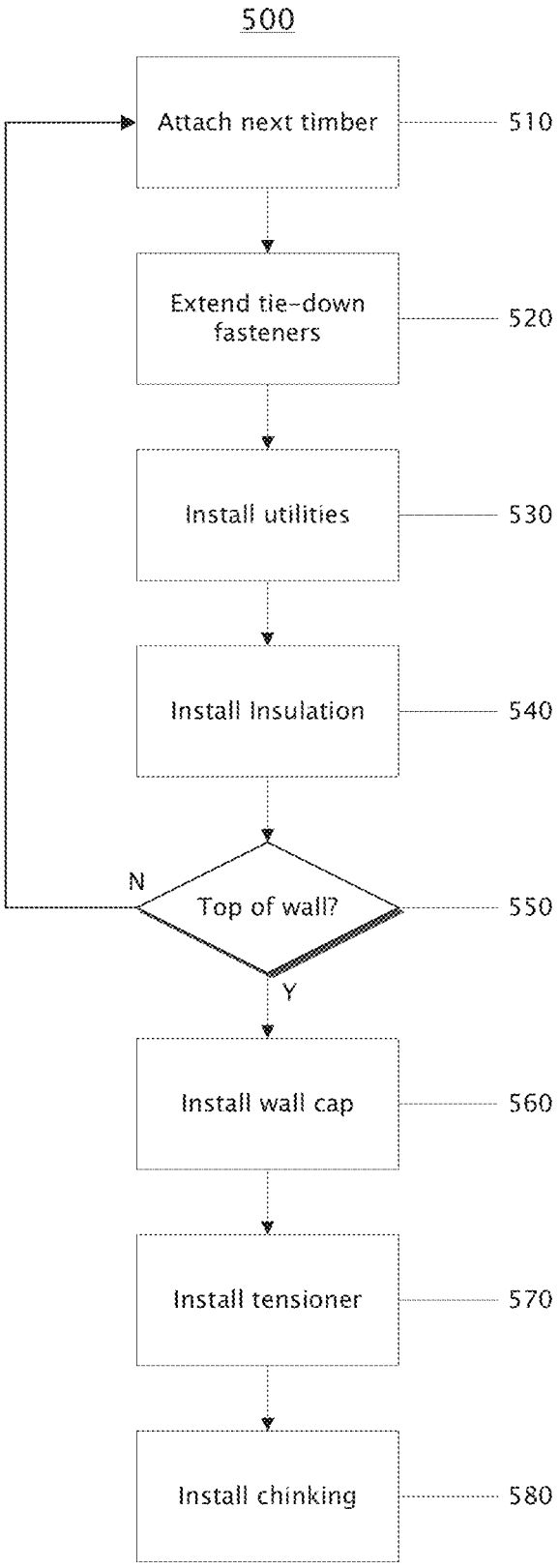
FIG. 5 is a diagram showing an example of a method for constructing a wall from fabricated timbers.

FIG. 5 is a diagram showing an example method 500 for constructing a wall from fabricated timbers. Block 510 typically indicates attaching a timber used in constructing the wall. In one example, the first or bottom fabricated timber of a wall is typically attached to a foundation as described in connection with at least FIG. 3, elements 100*i* and 316. In another example, a fabricated timber that is stacked upon another fabricated timber is attached as described in connection with at least FIG. 3, element 328. Further, holes are typically formed in fabricated timbers so as to enable tie-down fasteners to pass through the fabricated timber via the holes.

Further, one or more beads of caulking or glue or the like may be applied as a part of the attaching. In one example, a bead of caulking may be applied along the length of a top of a fabricated timber's vertical members (e.g., 110 and 120) prior to stacking another fabricated timber on top of it. Such a bead may be applied along the inside and/or outside edge(s) of the vertical members, or along any other portion of the vertical members. One such bead may be formed from a caulking or the like that is designed to remain flexible over time, cycles of hot and cold, and to seal out moisture, bugs, air, and or other substances and/or objects, and be further designed to maintain a seal given settling, movement, and/or shrinkage of the fabricated timbers. Another such bead may be formed from glue or construction adhesive or the like.

Block 520 typically indicates optionally extending a tie-down fastener(s) to pass through a next fabricated timber used to construct the wall. In one example, tie-down fasteners may be extended as described in connection with FIG. 3, elements 320 and 322. In another example, a tie-down fastener(s) may not require extending, such as in the case of using full wall height tie-down fasteners.

Block 530 typically indicates optionally installing utilities such as electrical wires, gas and/or water lines, ducting, and the like. In one example, electrical wires, water lines, gas lines, ducting, etc., may be run horizontally through the channel (FIG. 1*a*, 180) formed by a fabricated timber. Such may require forming holes/notches (e.g., 225) in blocking of the fabricated timber(s) to allow the utilities to pass through. In another example, electrical wires, water lines, gas lines, ducting, etc., may also be run vertically from one course of fabricated timbers to another. Such may require forming hole(s) in a horizontal member(s) of the fabricated timber(s) to allow the utilities to pass through. Further, holes may be formed in vertical member(s) of the fabricated timber(s) to allow the utilities to be accesses from the outside surface(s) of the fabricated timber(s). Such holes may be formed to allow for outlets, valves, vents, receptacles, etc.

Block 540 typically indicates optionally installing insulation. In one example, insulation is installed in the channel (FIG. 1*a*, 180) formed by a fabricated timber. Any form of insulation may be installed, or no insulation at all depending on the application of the wall and/or preferences of the builder. Generally, a sufficient quantity of a particular type of insulation is used to provide an insulation R-value (conventional measure of thermal resistance) sufficient for the purpose and location of the wall.

Once a particular course of fabricated timbers have been stacked and attached, any desired utilities have been run, and any tie-down fasteners have been installed and/or extended, then that course of fabricated timbers is typically complete and a next course may be attached. Block 550 typically indicates determining if there is at least one additional course to be added to the wall being constructed. If so, method 500 continues again at block 510. Otherwise method 500 continues at block 560.

Block 560 typically indicates installing a wall cap at the top of a fabricated timber-based wall. In one example, a wall cap may be fabricated and installed as described in connection with FIG. 3, elements 332, 334, and 336. Installing wall caps may include forming holes so as to enable tie-down fasteners to pass through the wall caps via the holes. Further, installing wall caps may include applying a bead(s) of caulking and/or glue or the like along the length of a top of the top fabricated timber's vertical members (e.g., 110 and 120) prior to installing a wall cap on top of it. Such a bead may be applied along the inside and/or outside edge(s) of the vertical members, or along any other portion of the vertical members. One such bead may be formed from a caulking or the like that is designed to remain flexible over time, through cycles of hot and cold, and to seal out moisture, bugs, air, and/or other substances and/or objects, and be further designed to maintain a seal given settling, movement, and/or shrinkage of the fabricated timbers and/or wall cap. Another such bead may be similarly applied that is formed of glue or construction adhesive or the like.

Block 570 typically indicates installing tensioner mechanisms to any tie-down fasteners. In one example, such may be installed inside a fabricated timber. In another example, such may be installed on wall caps at the top of a wall.

Block 580 typically indicates optionally installing chinking in any reveals of the constructed wall, such as reveal 140 of FIG. 1*a* that may be provided by fabricated timbers of the wall. Such chinking may comprise material that is intended to be functional and/or decorative in nature. Conventional chinking materials may be used, and/or other non-conventional chinking materials. For example, mortar, stucco, caulk, grout, and/or the like may be used for chinking. Any such materials may be applied using conventional means. In one example, wire mesh may be installed in the reveal area and the chinking material applied over the installed wire mesh. In another example, chinking material may be applied directly to the reveal areas of the stacked fabricated timbers. In another example, electrical wiring may be run along the reveal areas, nail guards installed to protect the electrical wiring, and chinking installed over the nail guard with or without wire mesh.

Figure 6B:
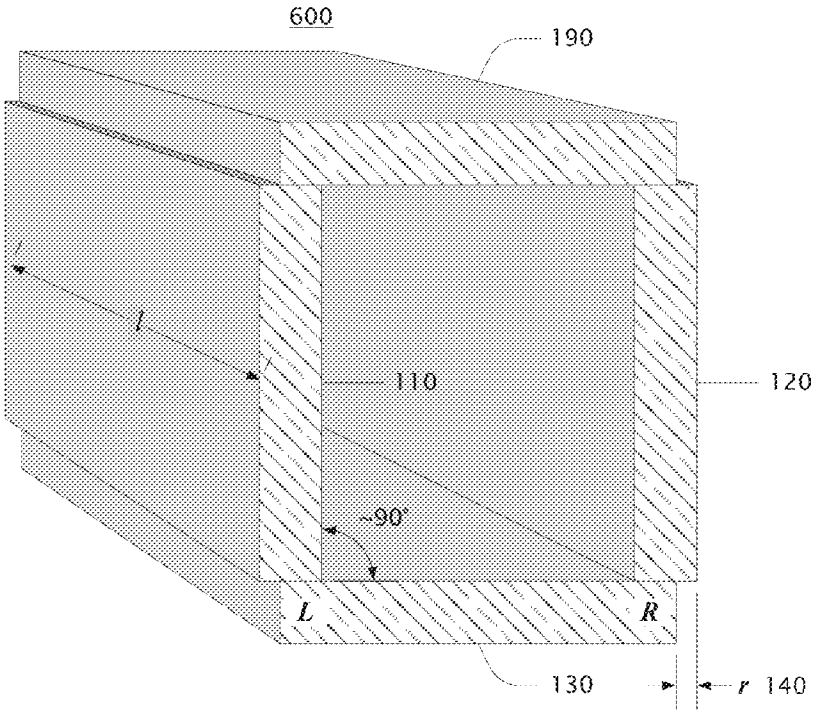
FIG. 6*b* is a diagram showing a 3-dimensional view of example alternate fabricated timber.
Figure 6A:
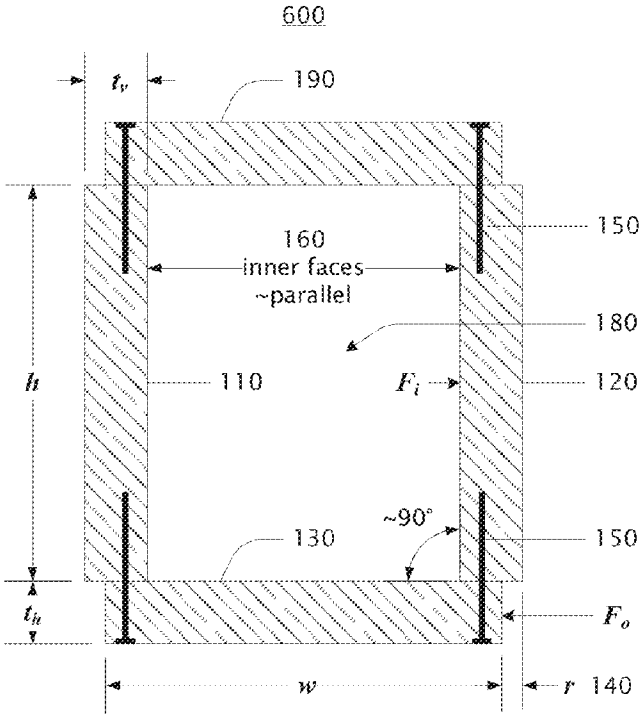
FIG. 6*a* is a diagram showing an end view of an example alternate fabricated timber.

FIG. 6*a* is a diagram showing an end view of an example alternate fabricated timber 600 with a 3-dimensional view the same example alternate fabricated timber 600 shown in FIG. 6*b*. Such a timber according to this example is typically fabricated in a similar manner to that of example fabricated timber of FIGS. 1*a* and 1*b*, with the additional of top horizontal member 190 that may have similar properties, attributes, uses, and characteristics to those of bottom horizontal timber 130. Further, such a timber according to this example can be used in conjunction with fabricated timbers (e.g., 100). In one example, alternate fabricated timbers (e.g., 600) may be used for the outside walls of a building while fabricated timbers (e.g., 100) may be used for inside walls of the same building. The two types of timbers (as well as other types) may even both be used in the same wall. Other combinations of the two timbers are also acceptable. Regarding construction of an alternate fabricated timber (e.g., 600), top horizontal member 190 may be attached to the tops of vertical members 110 and 120 in a manner similar to that of bottom horizontal member 130.

Alternate fabricated timbers (e.g., 600) may be fabricated to be insulated and fully enclosed either at a fabrication site or on a job site. Holes for tie-down fasteners may also be formed either at the fabrication site or on the job site. Blocking may be used to enclose the ends of an alternate fabricated timber, and may be built in at approximately two foot or greater intervals along the length of the timber. Blocking in both fabricated timbers and alternate fabricated timbers may also include holes configured to provide runs for utilities along the length of the inside of alternate fabricated timbers. An alternate fabricated timber may include conduit(s) installed in one or more sets of utility holes in the blocking, the conduit(s) typically extending from one end of the timber to the other. Such conduits may be used to run utilities through alternate fabricated timbers. Blocking in alternate fabricated timbers need not be included on either side of holes formed for tie-down fasteners. Further, horizontal members 130 and/or 190 may include channels or grooves along the length of their outer faces (not shown), the channels configured to provide a run for electrical wiring or the like.

Figure 6D:
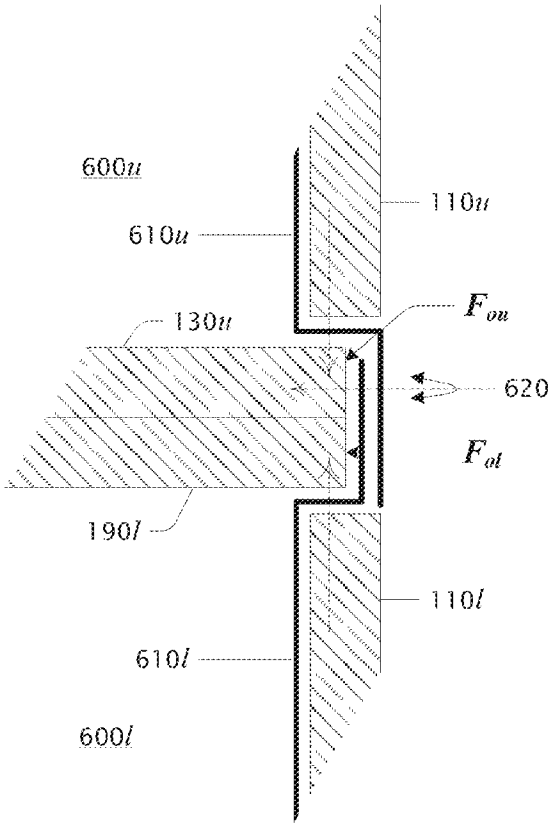
FIG. 6*d* is a diagram showing an example of sealing the adjoining reveals of two stacked fabricated timbers.
Figure 6C:
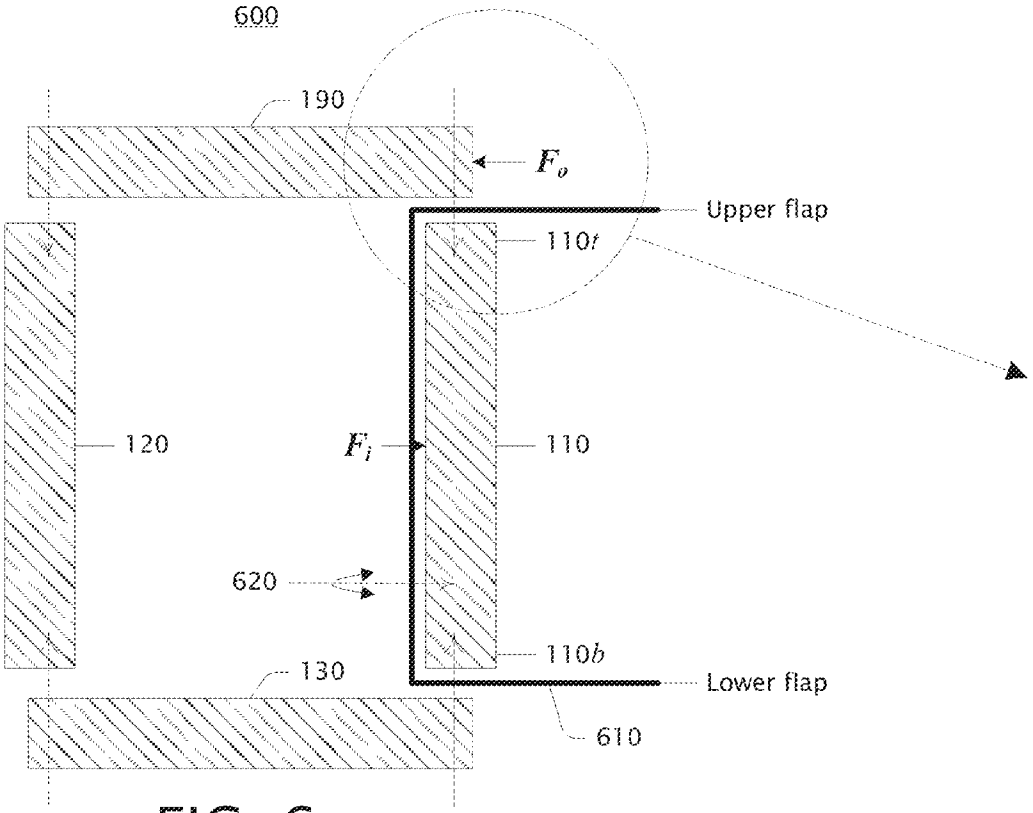
FIG. 6*c* is a diagram showing an example of incorporating housewrap in a fabricated timber.

FIG. 6*c* is a diagram showing an example of incorporating housewrap in a fabricated timber such as that shown in FIGS. 6*a* and 6*b* (that show additional detail not shown in FIG. 6*c*). In FIG. 6*c*, horizontal members 130 and 190 are shown separated from vertical members 110 and 120 to more clearly illustrate how the housewrap is incorporated into the timber; but this separation is for illustrative purposes only. The term "housewrap" as used herein refers to materials that function as weather-resistant barriers for preventing rain, snow, ice, and the like from getting inside a timber (e.g., 600 of FIGS. 6*a* and 6*b*) or a wall assembly constructed of such timbers (e.g., 700 of FIG. 7) while allowing water vapor to pass to the exterior. Some examples of housewraps include asphalt-impregnated materials such as paper or fiberglass or the like, and synthetic films and the like such as Tyvek. Fabricated timbers with house wrap incorporated can achieve superior weather resistance to conventional logs because as the latter age and crack moisture can get into and even through the wood. But fabricated timbers with house wrap properly incorporated can reduce or prevent such problems even if the outer layer of wood cracks or is otherwise damaged.

In one example, as shown in FIG. 6*c*, house wrap 610 is disposed over the entire inner face $F_i$ (i.e., over the entire length l and height h) of the outer vertical member 110 of the fabricated timber and folds over the top portion 110 and the bottom portion 110*b* of member 110, as illustrated, resulting in an upper flap of 610 and a lower flap of 610. The outer vertical member is typically the member that is exposed to the weather on the outside of a structure. But housewrap may alternatively or additionally be similarly incorporated in fabricated timbers on inside members (e.g., 120 of FIGS. 3 and 7). The housewrap may be attached to inner face $F_i$ (and/or to the top and bottom faces) of member 110 using any desired means, including adhesive and/or staples 620. These flaps are later used to seal the adjoining reveals of stacked fabricated timbers, as discussed later in connection with FIG. 6*d*. In addition to incorporating housewrap into fabricated timbers, exposed surfaces of such fabricated timbers may be coated, sealed, infused, dressed, or finished with a water-resistant or weather-resistant material, such as chemical treatments, sealants, coatings, films, or the like.

The term "backed and flapped housewrap" as used in the claims is defined herein to mean: housewrap that is disposed over an inner face of a vertical member of a fabricated timber and that folds over the top and bottom portions of the vertical member resulting in an upper and lower flap of the housewrap, as described in FIG. 6*c* and the corresponding written description.

Figure 7:
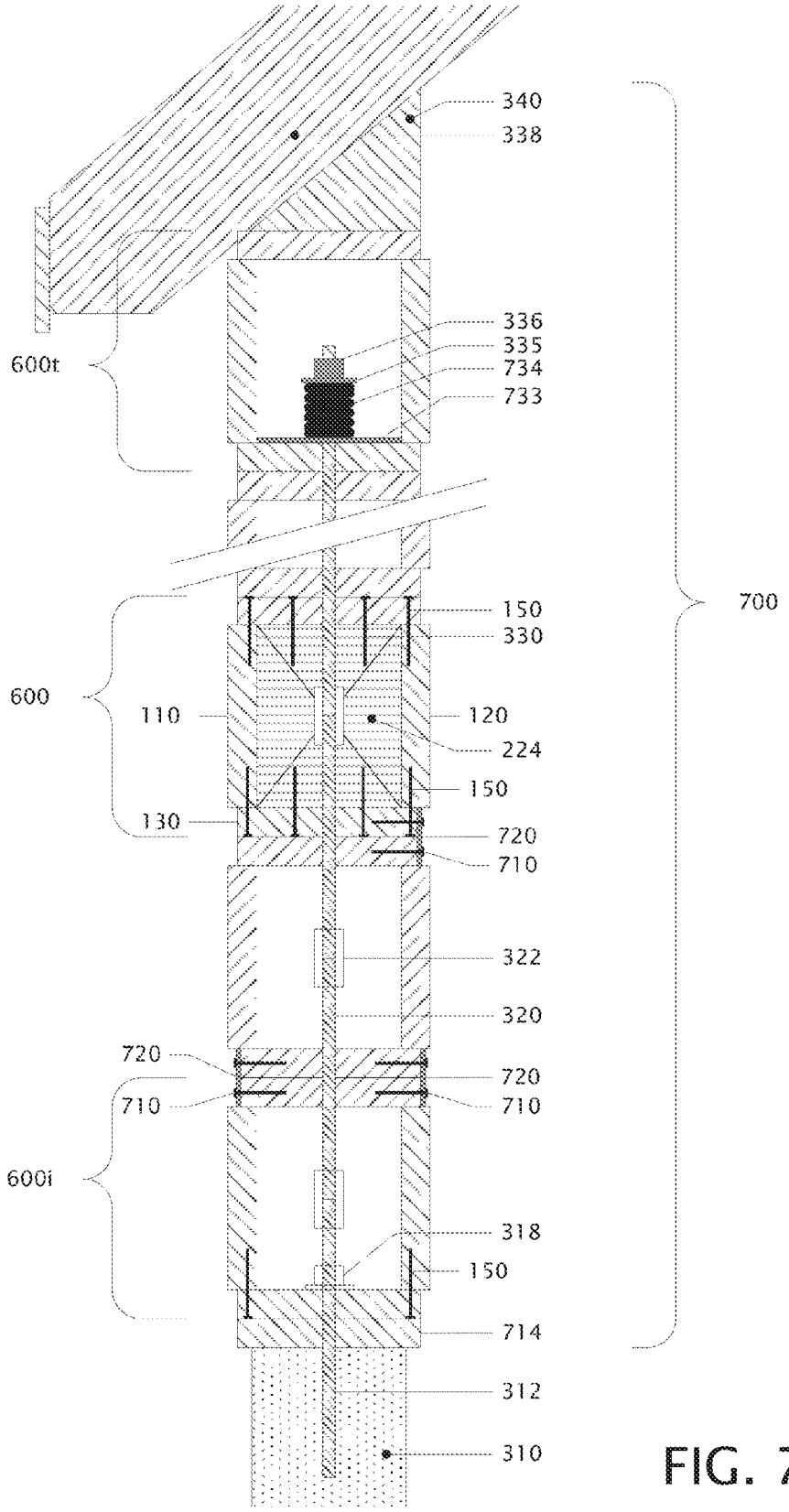
FIG. 7 is a diagram showing an example of a wall constructed from a plurality of example alternate fabricated timbers.

FIG. 7 is a diagram showing an example wall 700 constructed from a plurality of example alternate fabricated timbers (e.g., 600). Like reference numbers refer to like elements within FIG. 7 and between figures. Wall 700 is constructed in much the same way as wall 300, with some variations to account for the use of alternate fabricated timbers (e.g., 600) versus fabricated timbers (e.g., 100). One variation may be how one course of alternate fabricated timbers is attached to another course. In one example, strapping 720 is run along adjoining reveals of two stacked courses of alternate fabricated timbers and attached with fasteners 710 at regular intervals, such as approximately every twenty-four inches. Strapping 720 may be formed of solid or perforated metal or the like configured for using nails or the like as fasteners 710. Alternatively, strapping 720 may be formed of various sized plates or the like, or of construction tape or the like with adhesive or the like performing the function of fasteners 710. In another example, individual brackets or the like may be used at intervals along the length of courses. Other mechanisms may alternatively and/or additionally be utilized to lock one course to another course when using alternate fabricated timbers.

In one example, the tensioner mechanism and related components may be installed on top of the wall top cap. In another example, the tensioner mechanism may be installed inside the top fabricated timber 600*t* against its bottom horizontal member.

Another variation may be how blocking is locked into place in an alternate fabricated timber. In one example, blocking in alternate fabricated timbers may be installed at four-foot or less intervals. Fasteners may be installed via the top and bottom horizontal members of an alternate fabricated timber as opposed to via the vertical members. This approach has the advantage of fasteners not being visible on the outside vertical faces of an alternate fabricated timber.

Another variation may be how a tensioner mechanism and related components are configured. In one example, a plate 733 or the like may be used in conjunction with a tensioner mechanism and a washer 335 and nut 336. Plate 335 is typically configured to distribute forces from any tensioner mechanism(s) (e.g., 734) down the vertical members of alternate fabricated timbers to the foundation. Plate 335 may be made of metal or any other material configured to provide the required force distribution. In one example, plate 335 is a steel plate between ⅛" and ½" in thickness that extends substantially across the width of the mating surface of the bottom horizontal member. In another example, plate 335 may alternatively be formed of angle iron or the like, or I-beam or channel or the like.

Other variations may also include how a bottom course of alternate fabricated timbers is attached to a foundation, how a tie-down fastener is attached to an alternate fabricated timber, etc. Further, alternate fabricated timbers (e.g., 600) may be used in combination with fabricated timbers (e.g., FIG. 3, 100). In one example, regular fabricated timbers (e.g., FIG. 3, 100) may be used against a foundation as described in connection with FIG. 3, 100*i*, and a top horizontal member may optionally be added. In another example, regular fabricated timbers (e.g., FIG. 3, 100) may be used for a top course along with regular wall cap members (e.g., FIG. 3, 332/334). In another example, a member (e.g., 714) similar to a horizontal member of a fabricated timber may be disposed atop the foundation (e.g., 310) and a first alternate fabricated timber may be stacked and attached atop the member (e.g., 714). In one example, such a member (e.g., 714) may be made of pressure-treated 2× lumber or the like. Such a configuration may provide a reveal at a bottom course that is consistent in depth and height with that resulting from two alternate fabricated timbers being stacked one atop the other.

Weatherizing a wall constructed from a plurality of example alternate fabricated timbers (e.g., 600) and/or other styles of fabricated timbers (e.g., 100) may be desirable. In one example, such weatherizing can be accomplished by stacking fabricated timbers that incorporate housewrap, such as described in connection with FIG. 6*c*. An example of sealing the adjoining reveals of two stacked fabricated timbers is shown in FIG. 6*d*. The term "weatherize" in its various forms as used herein means to better protect fabricated timbers and/or walls constructed of fabricated timbers from the elements than they would be without being weatherized, where such elements may include weather conditions such as wind, rain, snow, ice, hail, heat, cold, any other weather condition, and any combination thereof.

First, as illustrated, the upper flap of housewrap 610*l* of lower fabricated timber 600*l* is folded up to cover the outer faces $F_{ol}$ and $F_{ou}$ of the adjoining reveals of the corresponding upper and lower fabricated timbers 600*u* and 600*l* respectively. The folded upper flap of housewrap 610*l* typically also covers any strapping or the like (e.g., 720 of FIG. 7) that may be used to join upper and lower fabricated timbers 600*u* and 600*l* respectively. The folded upper flap of housewrap 610*l* may then be trimmed such that it covers the entire faces $F_{ol}$ and $F_{ou}$ of the adjoining reveals for the entire length l of fabricated timbers 600*u* and 600*l*. The folded upper flap of housewrap 610*l* may also be attached along the length l of faces $F_{ol}$ and $F_{ou}$ of the adjoining reveals using any desired means, including adhesive and/or staples 620. In one example, trimming may be performed before the attaching. In another example, the attaching may be performed before the trimming.

Second, as illustrated, the lower flap of housewrap 610*u* of lower fabricated timber 600*u* is folded down to cover the folded upper flaps covering outer faces $F_{ol}$ and $F_{ou}$ of the adjoining reveals of the corresponding upper and lower fabricated timbers 600*u* and 600*l* respectively. The folded lower flap of housewrap 610*u* may then be trimmed such that it covers the entire faces $F_{ol}$ and $F_{ou}$ of the adjoining reveals for the entire length l of fabricated timbers 600*u* and 600*l*. The folded lower flap of housewrap 610*u* may also be attached along the length l of faces $F_{ol}$ and $F_{ou}$ of the adjoining reveals using any desired means, including adhesive and/or staples 620. In one example, trimming make be performed before the attaching. In another example, the attaching may be performed before the trimming.

House wrap may similarly be incorporated in walls constructed of other styles of fabricated timbers, including those illustrated in FIGS. 1*a*, 1*b*, 3, 8, 9, 10*a*, and 10*b*, or of any combination of types. The phrase "folded and sealed" with respect to backed and flapped housewrap as used in the claims is defined herein to mean: the backed and flapped housewraps of two stacked fabricated timbers of any type that are folded over their adjoining reveals as described in FIG. 6*d* and the corresponding written description.

It may be desirable to chink any reveals in walls that include any fabricated timbers that incorporate backed and flapped housewrap that have been folded and sealed. But, depending at least on the type of housewrap incorporated, various chinking materials may not adhere to the housewrap that covers the reveals of the housewrapped fabricated timbers. To solve this problem, in one example the housewrapped reveals are first coated with an adhesive that is capable of bonding to the housewrap and to the chinking material that will be used. Then, while the adhesive is at least somewhat wet or uncured, chinking material is applied on top of the adhesive. After the chinking is applied, the adhesive and the chinking are allowed to dry or cure.

Figure 8A:
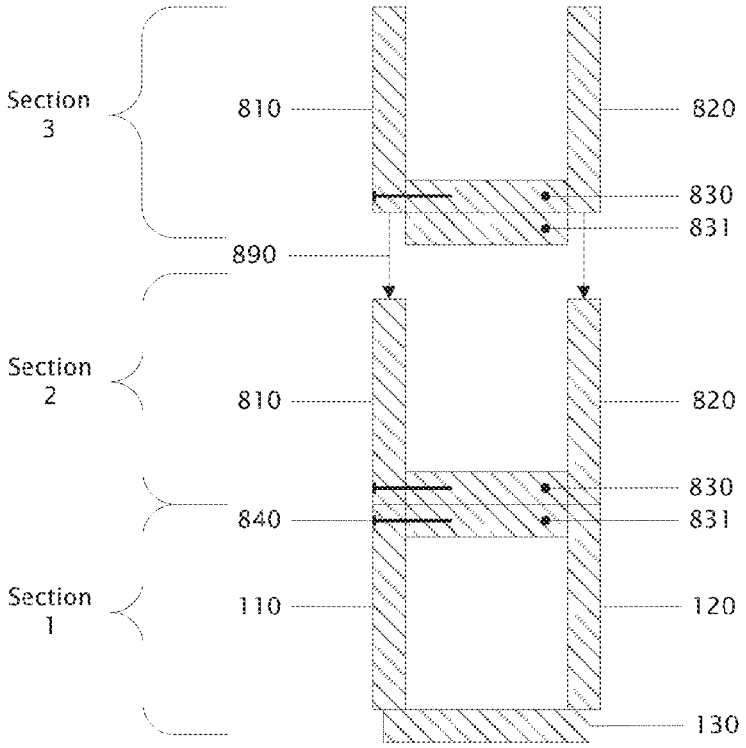
FIG. 8*a* is a diagram showing an example of a tall fabricated timber.
Figure 8B:
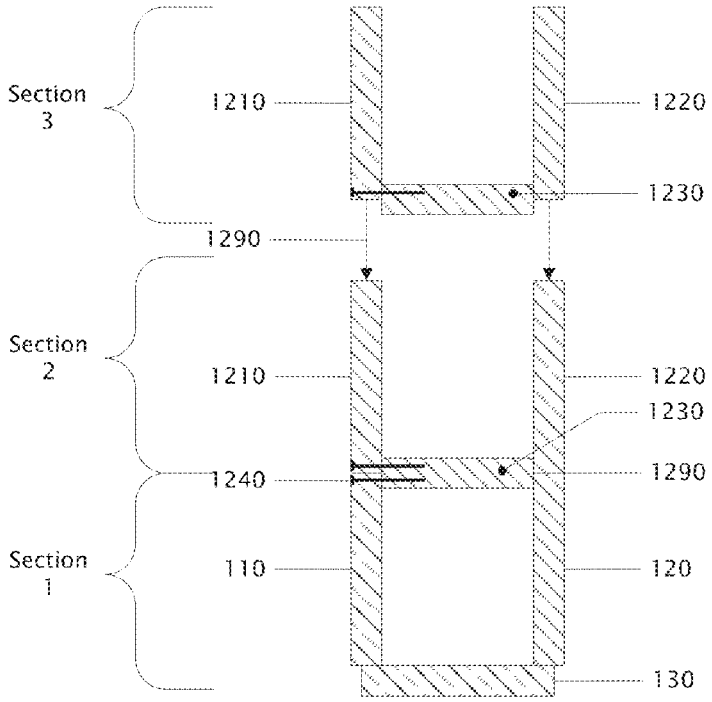
FIG. 8*b* is a diagram showing an example of another tall fabricated timber.

Tall solid wood timbers tend to be very expensive because old growth trees of sufficient size are scarce. Therefore, tall timbers tend to be desirable. FIG. 8*a* is a diagram showing an example of a tall fabricated timber that has the appearance of an expensive tall solid wood timber. Such a tall fabricated timber may be constructed for use as a fabricated timber (e.g., 100), as an alternate fabricated timber (e.g., 600), or as any other style of fabricated timber (e.g., FIGS. 9 and 10). FIG. 8*a* illustrates a tall fabricated timber comprising three sections. In one example, section 1 may be a fabricated timber (e.g., 100). Sections 2 and 3 are tall fabricated timber sections. Section 2 is shown stacked upon and attached to section 1 (e.g., using fasteners 840 on both sides). Arrows 890 indicates stacking section 3 on top of section 2. In one example, as illustrated by section 3, a tall fabricated timber section comprises vertical members 810 and 820 that are typically formed of substantially the same material as vertical members 110 and 120. The height of vertical members 810 and/or 820 need not be the same as that of 110 and 120 or of each other. In one example, the base member (e.g., 830+831) of each tall fabricated timber section is typically made of two pieces of 2× lumber attached together as illustrated. Alternatively, the base member may be made of a single piece of lumber or other material, as illustrated in FIG. 8*b*. Typically, the base member extends along the length of the section but may alternatively made of various pieces with gaps between.

The sections (e.g., sections 1-3) may be stacked, compressed, and attached as described elsewhere herein, resulting in a tall fabricated timber. Such a tall fabricated timber may be up to the height of a wall it is used to form. Each set of vertical members that make up a particular side of a tall fabricated timber, such as individual vertical member 120 of section 1, and individual vertical members 820 of sections 2 and 3, are referred to herein as a "compound vertical member"—that is, a compound vertical member is composed of more than one individual vertical member, such as 3 individual vertical members in the non-limiting examples illustrated in FIGS. 8*a* and 8*b*. Tall fabricated timbers typically include such composite vertical members.

FIG. 8*b* is a diagram showing an example of another tall fabricated timber. In this example, the base member (e.g., 1230) of each tall fabricated timber section is typically made of one piece of 2× lumber. In all other material aspects, the tall fabricated timber illustrated in FIG. 8*b* may be substantially the same as the tall fabricated timber illustrated in FIG. 8*a*.

Figure 9:
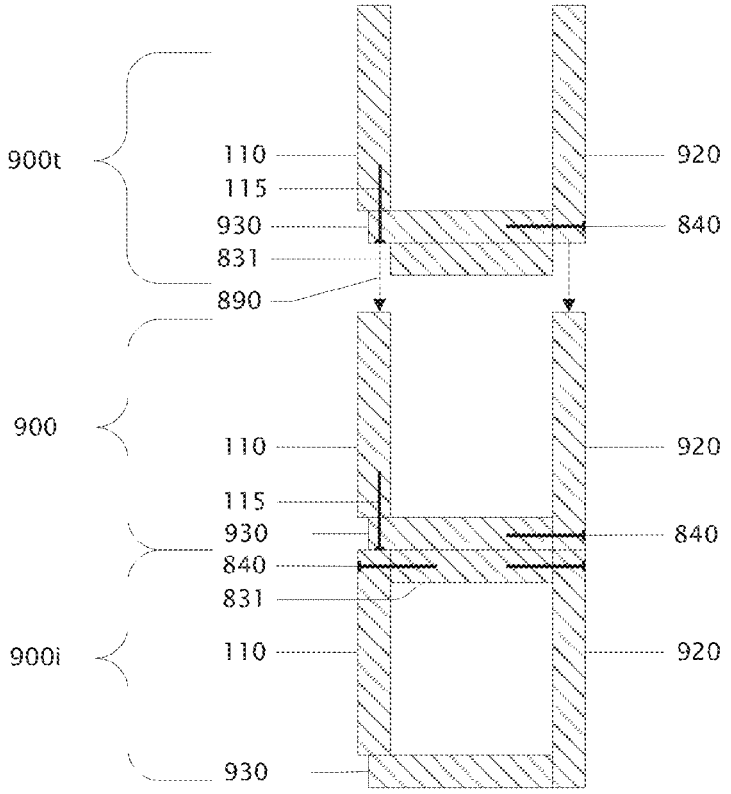
FIG. 9 is a diagram showing an example of construction of a single-reveal fabricated timber that has the appearance of a tall solid wood timber on one side and a reveal on the other side.

FIG. 9 is a diagram showing an example of construction of a single-reveal fabricated timber (e.g., 900*i*, 900, and 900*t*) that has the appearance of an expensive solid tall wood timber on one side and a reveal on the other side. Either side may be used on the inside or outside of a building. Such a single-reveal fabricated timber may be constructed in much the same manner as a fabricated timber (e.g., 100) and/or an alternate fabricated timber (e.g., 600). Vertical member 920 varies from vertical member 120 in that its height is the same as that of the entire timber. Horizontal member 930 varies from horizontal member 130 in that its width is sufficient to provide a desired reveal on one side while the end of the other side abuts the inside bottom face of vertical member 920 such that the bottom face of horizontal member 930 is even with and parallel to the bottom end of vertical member 920, as illustrated. Such single-reveal fabricated timbers may be stacked, compressed, and attached using fasteners (e.g., 840) as described elsewhere herein.

Figure 10:
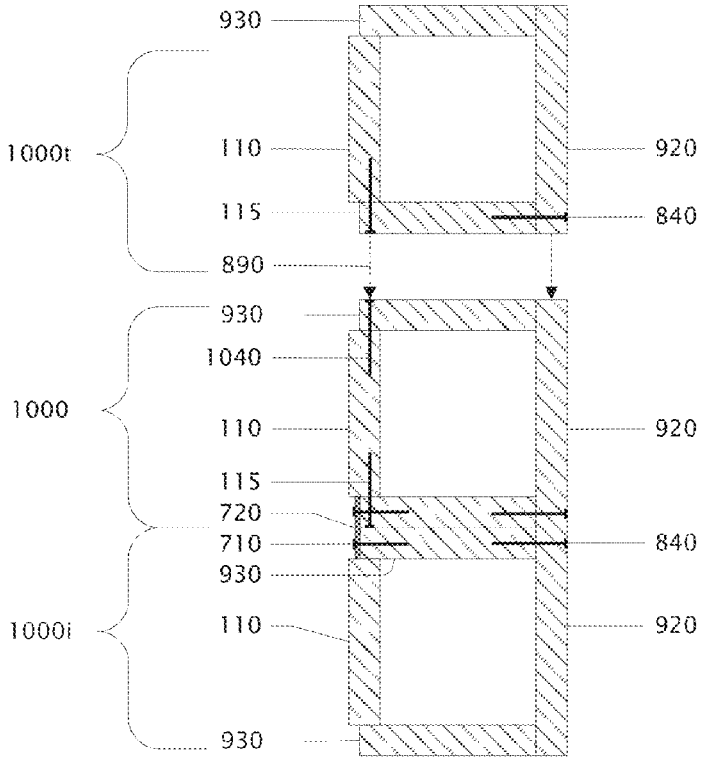
FIG. 10 is a diagram showing an example of construction of a single-reveal alternate fabricated timber that has the appearance of a tall solid wood timber on one side and a reveal on the other side.

FIG. 10 is a diagram showing an example of construction of a single-reveal alternate fabricated timber (e.g., 1000*i*, 1000, and 1000*t*) that has the appearance of an expensive solid tall wood timber on one side and a reveal on the other side. Either side may be used on the inside or outside of a building. Such a single-reveal alternate fabricated timber may be constructed in much the same manner as a fabricated timber (e.g., 100) and/or an alternate fabricated timber (e.g., 600). Vertical member 920 varies from vertical member 120 in that its height is the same as that of the entire timber. Top and bottom horizontal members 930 vary from horizontal member 130 in that their width is sufficient to provide a desired reveal on one side while the end of the other side abuts the corresponding inside top or bottom face of vertical member 920 such that the corresponding top or bottom face of horizontal member 930 is even with and parallel to the corresponding top or bottom end of vertical member 920, as illustrated. Such single-reveal alternate fabricated timbers may be stacked, compressed, and attached using fasteners (e.g., 710, 720, and 840) as described elsewhere herein.

Figure 11B:
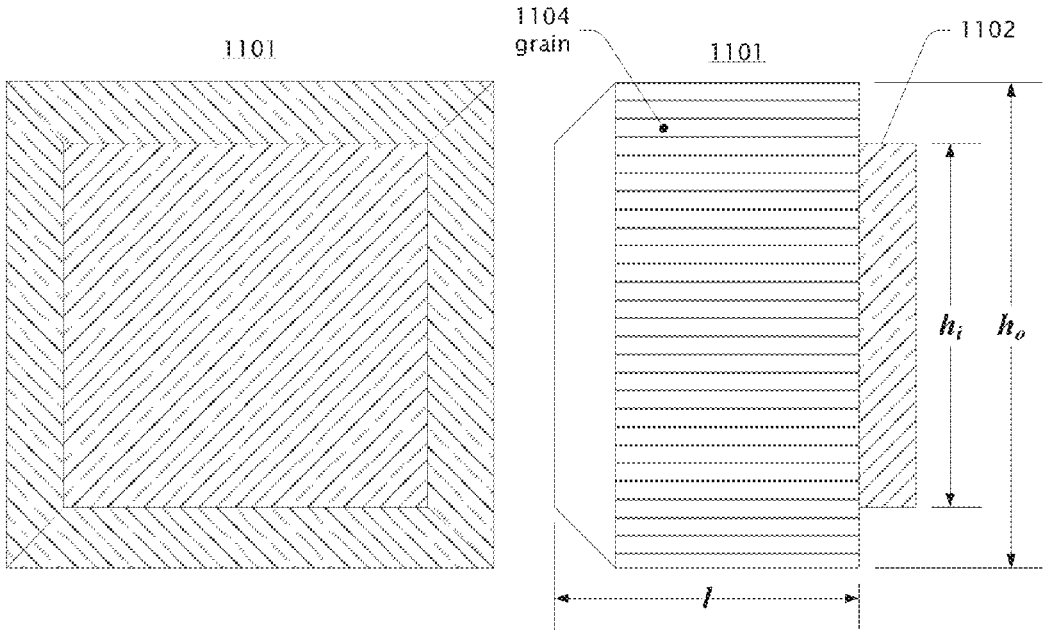
FIG. 11*b* is a diagram showing front and side views of an example of another fabricated timber end cap.
Figure 11A:
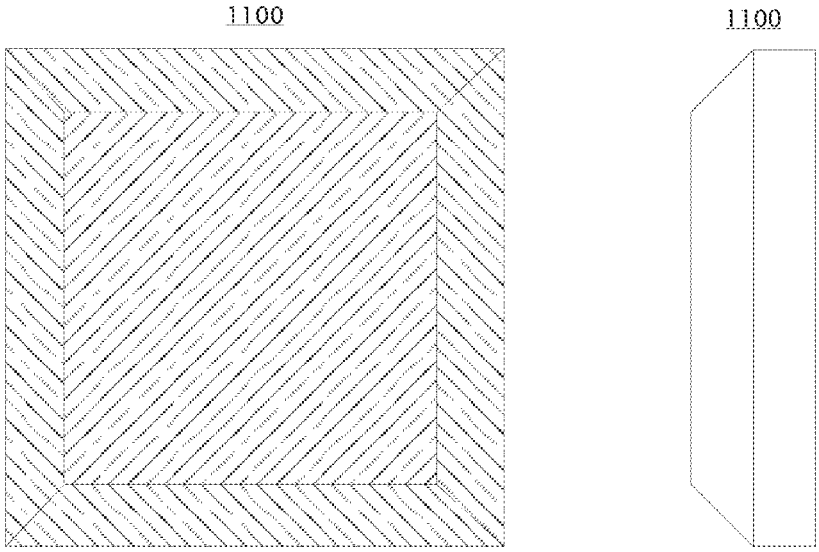
FIG. 11*a* is a diagram showing front and side views of an example of a fabricated timber end cap.

FIG. 11*a* is a diagram showing front and side views of an example of a fabricated timber end cap (e.g., 1100). Such end caps may be attached to exposed/open ends of wall timbers where the height and width of each end cap is typically substantially equal to the height and width of the timber end. Any suitable method of attachment may be used, including fasteners such as nails, glue, and/or any others indicated herein and/or the like. Each end cap may be beveled, as illustrated, or otherwise shaped as desired. Further, such end caps may be dressed, either prior to or after attachment, so as to match the appearance of the timbers to which they are attached and/or to create the appearance of being integral portions of such timbers.

FIG. 11*b* is a diagram showing front and side views of an example of another fabricated timber end cap (e.g., 1101). The length l of this example end cap may be significantly longer than that of end cap 1100; it may be up to several feet or more in length so as to give the appearance of extending the fabricated timber to which it is mounted. The end cap may be shaped in any desirable fashion, such as with beveled edges at the end (as shown) or otherwise. The end cap typically has an outer height $h_o$ and width $w_o$ (not shown) that is substantially the same as the outer height and width of the fabricated timber being finished by the end cap. Further, end cap 1100 may be composed of any materials in any combination of which any fabricated timber may be composed.

End cap 1101 may include a mounting end (e.g., 1102) configured for being snuggly inserted into an open end of the fabricated timber being finished by the end cap. Glue and/or fasteners of any desired type may be used to retain the end cap in place. The mounting end is typically of an outside height $h_i$ and width $w_i$ (not shown) that is substantially the same as the inner height and width of the open end of the fabricated timber being finished by the end cap.

End cap 1101 may include a natural or artificial grain 1104 (e.g., a wood grain) that is oriented substantially consistent with any grain of the fabricated timber being finished by the end cap. In this manner, the end cap and the fabricated timber may provide the appearance of being a single piece. Further, any exposed joints between the fabricated timber and the end cap may be dressed as described in FIG. 12 and the corresponding written description. In all other material aspects, end cap 1101 may be the same as end cap 1100.

Figure 12:
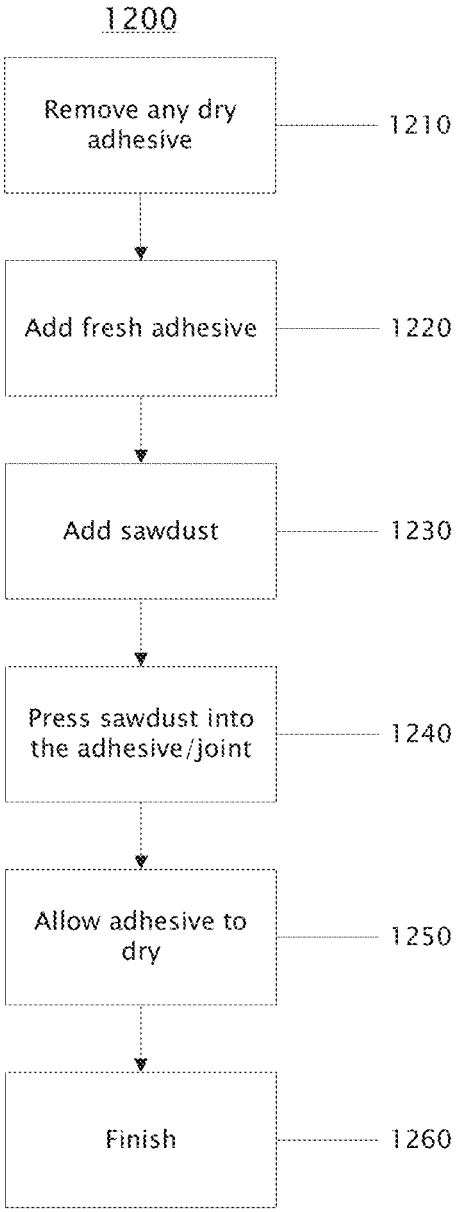
FIG. 12 is a diagram showing an example method 1200 for dressing joints of a fabricated timber, etc.

FIG. 12 is a diagram showing an example method 1200 for dressing joints of a fabricated timber, including a tall fabricated timber, and joints of walls constructed of fabricated timbers. Method 1200 may also be applied to dress joints associated with end caps, such as those described in FIGS. 11*a* and 11*b*, or any other joints, seams, junctions, interfaces, cracks, gaps, fissures, flaws, or the like (all referred to herein by the term "joints") in a fabricated timber or in various other surfaces. Method 1200 is particularly applicable to dressing joints in wood. Properly performed, performance of method 1200 can result in benefits including hiding such joints to give the appearance that the joints do not exist. In particular, given a tall fabricated timber with at least one compound vertical member, joints such as those between individual vertical members (e.g., 1290 of FIG. 8*b*) of a compound vertical member, or any other joints, such as any between an end cap and a fabricated timber of any style, can be dressed based on method 1200 to provide the benefits thereof. The term "joint surface" as used herein is defined to mean any surface of a fabricated timber, of a wall constructed of fabricated timbers, of any end cap, of any other surface such as a wood surface that includes a joint as defined above, and any combination thereof.

Method 1200 applies to any joint as defined above, and block 1210 typically indicates removing any dry adhesive protruding from a joint of a joint surface. In one example, the removing can be quickly accomplished using an angle grinder. Once any protruding glue has been removed, the method continues at block 1220.

Block 1220 typically indicates applying fresh adhesive in the joint. In one example, a bead of adhesive is applied along the joint. Once the fresh adhesive has been applied, the method continues at block 1220.

Block 1230 typically indicates applying sawdust to the freshly applied adhesive. In one example, the sawdust is of the same type of wood from which the joint surface is composed. The sawdust may be applied liberally. In one example, the freshly applied adhesive may be allowed to partially cure prior to applying the sawdust. Once the sawdust has been applied, the method continues at block 1240.

Block 1240 typically indicates pressing the applied sawdust and the applied adhesive into the joint. In one example, the mixture of adhesive and sawdust may be allowed to partially cure prior to pressing. In one example, the pressing is accomplished by pounding the mixture into the joint using a mallet or the like. An amount of sawdust may be applied at block 1230 such that the pressed-in mixture is substantially flush with the joint surface and such that the joint is densely packed with the pressed-in sawdust. Once the sawdust and adhesive have been pressed-in, the method continues at block 1250.

Block 1250 typically indicates allowing the pressed-in mixture of adhesive and sawdust to cure. Once the pressed-in mixture has cured, the method continues at block 1250.

Block 1250 typically indicates finishing the joint. In one example, the finishing is accomplished by sanding the joint such that the appearance and texture of the joint is consistent with the appearance and texture of the joint surface. In another example, the finishing is accomplished by distressing the joint and the joint surface with a chainsaw or the like resulting in an overall appearance and texture of a rough-hewn log.

The invention claimed is:

1. A fabricated timber comprising:

a first vertical member that is substantially cuboid in shape and that is of a first length of at least one foot, and of a first height of at least three inches, and of a first thickness;

a second vertical member that is substantially cuboid in shape and that is of a second length of at least one foot, and of a second height of at least three inches, and of a second thickness; and a horizontal member that is substantially cuboid in shape and that is of a length of at least one foot, and of a width of at least three inches, and of a third thickness, the first vertical member disposed length-wise upon a left length-wise top edge of the horizontal member, a vertical plane of the first vertical member substantially perpendicular to a horizontal plane of the horizontal member, the second vertical member disposed length-wise upon a right length-wise top edge of the horizontal member, a vertical plane of the second vertical member substantially perpendicular to the horizontal plane of the horizontal member and substantially parallel with the vertical plane of the first vertical member, where a right outer face and a left outer face of the horizontal member that are length-wise parallel with the disposed first vertical member and the disposed second vertical member are not covered by the first vertical member or by the second vertical member, where the first vertical member is disposed length-wise along the left length-wise top edge of the horizontal member resulting in a reveal of a bottom of the first vertical member of up to at least fifty percent of the first thickness, and where a plurality of timbers including the fabricated timber stacked one atop another form a wall.

2. The fabricated timber of claim 1 where the first vertical member or the second vertical member is a compound vertical member.

3. The fabricated timber of claim 2 where a grain of a first vertical member of the compound vertical member is oriented substantially in a same plane as a grain of a second vertical member of the compound vertical member.

4. The fabricated timber of claim 2 where a joint in a joint surface of two adjoining vertical members of the compound vertical member is dressed such that an appearance of the joint is substantially consistent with an appearance of the joint surface.

5. The fabricated timber of claim 1 where the fabricated timber is a tall fabricated timber comprising two tall fabricated timber sections.

6. The fabricated timber of claim 5 where one of the tall fabricated timber sections comprises a two-piece base member.

7. The fabricated timber of claim 5 where one of the tall fabricated timber sections comprises a single-piece base member.

8. The fabricated timber of claim 5 where a grain of a vertical member of a first of the two tall fabricated timber sections is oriented substantially in a same plane as a grain of a vertical member of a second of the two tall fabricated timber sections.

9. The fabricated timber of claim 5 where a joint in a joint surface of two adjoining vertical members of the two tall fabricated timber sections is dressed such that an appearance of the joint is substantially consistent with an appearance of the joint surface.

10. A method of constructing a fabricated timber, the method comprising:

disposing a first vertical member that is substantially cuboid in shape length-wise upon a left length-wise top edge of a horizontal member that is substantially cuboid in shape, a vertical plane of the first vertical member substantially perpendicular to a horizontal plane of the horizontal member, the first vertical member of a first length of at least one foot, and of a first height of at least three inches, and of a first thickness, and the horizontal member of a length of at least one foot, and of a width of at least three inches, and of a third thickness; and disposing a second vertical member that is substantially cuboid in shape length-wise upon a right length-wise top edge of the horizontal member, a vertical plane of the second vertical member substantially perpendicular to the horizontal plane of the horizontal member and substantially parallel with the vertical plane of the first vertical member, the second vertical member of a second length of at least one foot, and of a second height of at least three inches, and of a second thickness, where a right outer face and a left outer face of the horizontal member that are length-wise parallel with the disposed first vertical member and the disposed second vertical member are not covered by the first vertical member or by the second vertical member, where the first vertical member is disposed length-wise along the left length-wise top edge of the horizontal member resulting in a reveal of a bottom of the first vertical member of up to at least fifty percent of the first thickness, and where a plurality of timbers including the fabricated timber stacked one atop another form a wall.

11. The method of claim 10 where the first vertical member or the second vertical member is a compound vertical member, or where the fabricated timber is a tall fabricated timber comprising two tall fabricated timber sections, or where a channel formed by the fabricated timber comprises insulation, blocking, ducting, electrical wires, or other utilities, or where an end cap is attached to an end of the fabricated timber.

12. The method of claim 10 further comprising aligning two adjoining vertical members comprised by the first vertical member or by the second vertical member, where a grain of a first of the aligned two adjoining vertical members is oriented substantially in a same plane as a grain of a second of the aligned two adjoining vertical members.

13. The method of claim 10 dressing a joint in a joint surface of two adjoining vertical members comprised by the first vertical member or by the second vertical member, where an appearance of the dressed joint is substantially consistent with an appearance of the joint surface.

14. A method of dressing a joint in a joint surface of two adjoining members of a fabricated timber, the method comprising:

pressing a mixture of sawdust and adhesive into the joint; and finishing, after the pressing, the joint;

where the fabricated timber comprises:

a first vertical member that is substantially cuboid in shape and that is of a first length of at least one foot, and of a first height of at least three inches, and of a first thickness;

a second vertical member that is substantially cuboid in shape and that is of a second length of at least one foot, and of a second height of at least three inches, and of a second thickness; and a horizontal member that is substantially cuboid in shape and that is of a length of at least one foot, and of a width of at least three inches, and of a third thickness, the first vertical member disposed length-wise upon a left length-wise top edge of the horizontal member, a vertical plane of the first vertical member substantially perpendicular to a horizontal plane of the horizontal member, the second vertical member disposed length-wise upon a right length-wise top edge of the horizontal member, a vertical plane of the second vertical member substantially perpendicular to the horizontal plane of the horizontal member and substantially parallel with the vertical plane of the first vertical member, where a right outer face and a left outer face of the horizontal member that are length-wise parallel with the disposed first vertical member and the disposed second vertical member are not covered by the first vertical member or by the second vertical member, where the first vertical member is disposed length-wise along the left length-wise top edge of the horizontal member resulting in a reveal of a bottom of the first vertical member of up to at least fifty percent of the first thickness, and where a plurality of timbers including the fabricated timber stacked one atop another form a wall.

15. The method of claim 14 where the pressed-in mixture is substantially flush with the joint surface.

16. The method of claim 14 where the finishing comprises sanding the joint to an appearance and a texture that is consistent with an appearance and a texture of the joint surface.

17. The method of claim 14 where the finishing comprises distressing the joint and the joint surface to an appearance and a texture consistent with a rough-hewn log.

18. The method of claim 14 where the first vertical member or the second vertical member is a compound vertical member that comprises the joint.

19. The method of claim 14 where the fabricated timber is a tall fabricated timber comprising two tall fabricated timber sections that comprise the joint.

20. The fabricated timber of claim 1 where a channel formed by the fabricated timber comprises insulation, blocking, ducting, electrical wires, or other utilities, or where an end cap is attached to an end of the fabricated timber.

* * * * *